US008241826B2

(12) United States Patent
Hirano et al.

(10) Patent No.: US 8,241,826 B2
(45) Date of Patent: Aug. 14, 2012

(54) FULL-COLOR IMAGE FORMING METHOD

(75) Inventors: Shiro Hirano, Tokyo (JP); Mikio Kouyama, Tokyo (JP); Kenji Hayashi, Tokyo (JP); Hiroyuki Yasukawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 650 days.

(21) Appl. No.: 12/434,001

(22) Filed: May 1, 2009

(65) Prior Publication Data

US 2009/0291376 A1 Nov. 26, 2009

(30) Foreign Application Priority Data

May 23, 2008 (JP) ..... 2008-135425

(51) Int. Cl.
*G03G 13/06* (2006.01)

(52) U.S. Cl. ..... 430/120.1; 430/123.41; 430/123.5; 430/123.55; 430/123.57

(58) Field of Classification Search ..... 430/120.1, 430/123.41, 123.5, 123.55, 123.57
See application file for complete search history.

(56) References Cited

U.S. PATENT DOCUMENTS

2007/0166636 A1* 7/2007 Daimon et al. ..... 430/109.3
2008/0025754 A1* 1/2008 Ishiyama et al. ..... 399/106
2009/0075196 A1* 3/2009 Matsubara et al. ..... 430/110.1

* cited by examiner

*Primary Examiner* — Hoa V Le
(74) *Attorney, Agent, or Firm* — Lucas & Mercanti, LLP

(57) ABSTRACT

Disclosed is a full-color image forming method by which an image exhibiting comfortable image quality reliably suitable for a human visual system can be obtained in such a way that a halftone image exhibiting excellent granularity and evenness thereof is acquired.

9 Claims, 1 Drawing Sheet

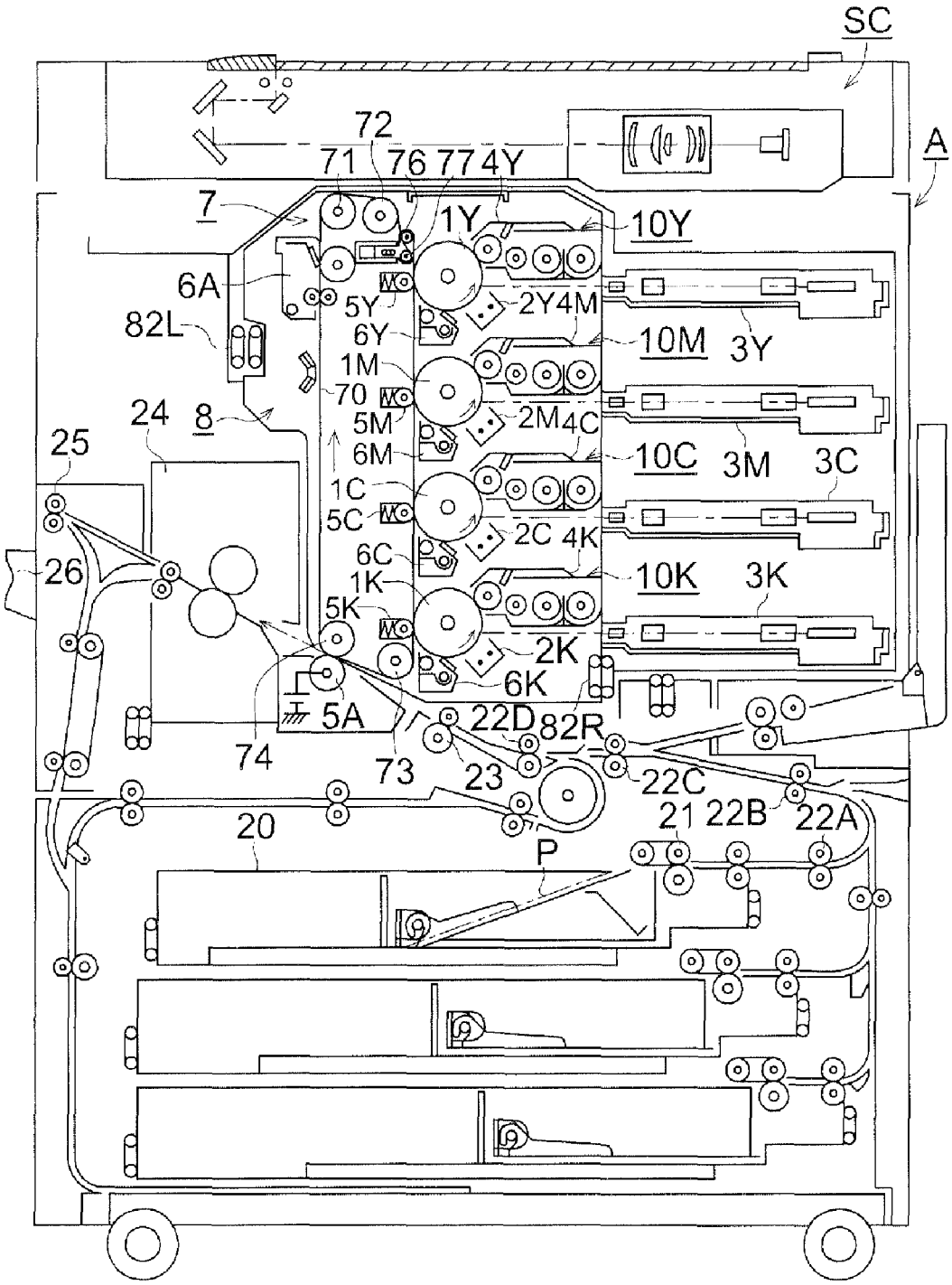
SC
A
72
71
76
77
4Y
7
1Y
10Y
6A
5Y
2Y
4M
82L
6Y
10M
3Y
1M
70
5M
2M
4C
24
8
25
6M
10C
3M
3C
1C
5C
2C
4K
26
6C
1K
10K
3K
5K
2K
6K
5A
22D
82R
74
73
23
22C
21
22B
22A
20
P

FULL-COLOR IMAGE FORMING METHOD

CROSS REFERENCE TO RELATED APPLICATION

This Application claims the priority of Japanese Patent Application No. 2008-135425 filed May 23, 2008 the entire contents of which are hereby incorporated by reference.

TECHNICAL FIELD

The present invention relates to an electrophotographic full-color image forming method by which full-color image formation is conducted with at least yellow toner, magenta toner and cyan toner.

BACKGROUND

As a color image forming apparatus with an electrophotographic system, there are the apparatuses, for example, from those designed for office use such as a color printer or a color copier to those used in the commercial printing field, which are called desk-top publishing (DTP) and on-demand publishing. In this commercial printing field, preferably employed are those such as pre-press machines which are employed in the preparatory stages before preparing plates for mass-printing, and apparatues performing quick printing of a small lot such as several thousand prints to several ten thousand prints.

Incidentally, in commercial printing of color images, demanded are commercial photographs and background images exhibiting subtle tone and excellent granularity. In the electrophotographic method, specifications in recording density have been increased year after year because of the progress of an optical source such as laser, a LED or the like, and an optical system thereof, but problems concerning a photographic image and halftone granularity have been left over since no developing stability can be followed with respect to the dot diameter of color toner.

Further, also in the case of color reproduction, there was a problem such that corporate color and logo mark of each enterprise, and coloring of most of trademarks and products were not covered within the color reproduction range of printing standard color. In this way, one of the reasons is that no coverage within the color reproduction range leads to what each enterprise or association exercises its ingenuity in color to transmit a message to viewers via color tone. Accordingly, it is not rare that in the past, corporate color, logo mark, trademark or the like has been output by using a specific one called special color toner.

In such the way, since there is still a gap between the printing standard color and the human perceivable color gamut range, technology development to fill the foregoing gap is in progress in the field of displays such as a TV and the like so as to obtain reasonably comfortable color images to the sight. Specifically, the following Patent Documents 1 and 2 can be cited, but techniques disclosed in these documents remain at the level of conventional commercial printing, and color reproduction demanded in the present situation where digitalization is promoted has not been realized. For example, when preparing halftone images in which comfortable image quality is specifically desired, textured image quality feeling originated by area tone with dots is undeniable, whereby uniform image quality with no unevenness has been demanded. Further, since insufficient appearance of solidity is obtained when outputting photographic images, there are quite a few users feeling short on the images.

(Patent Document 1) Japanese Patent O.P.I. Publication No. 2005-315058

(Patent Document 2) Japanese Patent O.P.I. Publication No. 11-338190

SUMMARY

The present invention was made on the basis of the above-described situation. That is, it is an object of the present invention to provide a full-color image forming method by which reasonably comfortable color images to the sight can be obtained. Specifically, it is an object of the present invention to provide a full-color image forming method by which excellent granularity can be obtained, and uniform images with no unevenness can also be obtained when preparing halftone images. It is an object of the present invention to further provide a full-color image forming method capable of preparing images exhibiting sufficient appearance of solidity when outputting photographic images.

BRIEF DESCRIPTION OF THE DRAWING

FIG. 1 is a schematic diagram showing an example of a tandem type full-color image forming apparatus capable of conducting two-component developing system image formation.

DESCRIPTION OF THE PREFERRED EMBODIMENTS

The above object of the present invention is accomplished by any of the following structures.

(Structure 1) A full-color image forming method comprising the step of forming a full-color image employing at least a yellow toner, a magenta toner and a cyan toner, wherein lightness $L^*_Y$ is in the range of 80-90 when a first toner image formed with only the yellow toner exhibits a maximum chroma; lightness $L^*_M$ is in the range of 35-51 when a second toner image formed with only the magenta toner exhibits a maximum chroma; and lightness $L^*_C$ is in the range of 53-70 when a third toner image formed with only the cyan toner exhibits a maximum chroma.

(Structure 2) The full-color image forming method of Structure 1, wherein lightness $L^*_Y$ is in the range of 85-90 when a first toner image formed with only the yellow toner exhibits a maximum chroma; lightness $L^*_M$ is in the range of 40-49 when a second toner image formed with only the magenta toner exhibits a maximum chroma; and lightness $L^*_C$ is in the range of 57-67 when a third toner image formed with only the cyan toner exhibits a maximum chroma.

(Structure 3) The full-color image forming method of Structure 1 or 2, wherein the first toner image formed with only the yellow toner has a maximum chroma $C^*_Y$ of 85-115; the second toner image formed with only the magenta toner has a maximum chroma $C^*_M$ of 70-100; and the third toner image formed with only the cyan toner has a maximum chroma $C^*_C$ of 50-80.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

The full-color image forming method of the present invention is a method by which full-color images are formed employing at least a yellow toner, a magenta toner and a cyan toner. The inventors have found out that reasonably comfortable high quality images to the sight can be obtained not only in the case of reflection spectrum of each monochromatic toner image formed by yellow toner, magenta toner or cyan toner, but also when lightness in cases where each toner image exhibits the maximum chroma is in the specific range. Specifically, granularity and evenness in a secondary color halftone image are largely improved, and for example, eye-friendly comfortable high quality-finishing images exhibiting appearance of solidity and evenness are able to be prepared when preparing a photographic image.

The inventors first considered putting settings of lightness for a yellow toner, a cyan toner and a magenta toner closer. In the toner image, a transfer sheet, fixing temperature, viscoelasticity of the toner, and also the releasing agent condition cause a margin of error in toner thermal deformation, whereby thickness of a fixing image and toner dot area influence roughness of the image and color-developing. It was considered that granularity and evenness in a secondary color halftone image were largely improved, and thereby, chroma of a secondary color such as blue, red, green or the like was enlarged by putting specifically, lightness of a cyan toner and lightness of a magenta toner close to lightness of yellow in the specific lightness range. Further, the inventors also considered that to prepare an optimal image suitable for human visual sensitivity with three colors of yellow, magenta and cyan was a key, in order to be arranged to produce a color image of an eye-friendly comfortable high quality color tone. And, then a toner image design suitable for the human visual sensitivity was studied by remodeling a color design theory based on a model of Munsell color system.

The Munsell color system is a color space of Munsell capable of showing colors based on three dimensions of hue lightness and chroma. That is, L-axis represented as lightness is located in the center of a hue ring, an axis on the side heading for the bottom from the hue ring is represented as the direction of turning black, and an axis on the side heading for the top is represented as the direction of turning white. Further, a distance from the axis represents chroma, and with a distance getting away from the axis, chroma is increased. Further, the color space of Munsell does not form a perfect sphere, but a distorted sphere. This indicates that human visual sensitivity can not sense all the hues evenly.

That is, human visual cells possess four kinds of a rod cell, a blue cone cell, a green cone cell and a red cone cell, but among these, the rod cell to sense lightness has a peak of a sensitivity curve at 510 nm. Further, the blue cone cell (B cone) exhibits sensitivity at 400-500 nm, and a peak thereof is at 430 nm. The green cone cell (G cone) exhibits sensitivity at 550-650 nm as a medium wavelength range, and a peak thereof is at 530 nm. Further, the red cone cell (R cone) exhibits sensitivity at 550-650 nm as a long wavelength range, and a peak thereof is at 560 nm. The peak of the red cone cell is not always in the red region, but rather in the region of yellow from yellowish green.

The inventions thought that lightness of the magenta toner serving as the long wavelength, in which sensitivity of a rod cell is low, could be designed to be higher than usual. Further, they thought that lightness of the cyan toner could be designed to be higher than usual, since the short wavelength range exhibited a color tone with magenta and cyan. After considerable effort during intensive studies, the inventors have noticed that expressiveness of the image dark area is degraded in cases where lightness of this toner image is simply raised. After further intensive studies, the inventors have found out that the effect produced by identifying lightness at the maximum chroma is generated. Namely, ideal distortion of the color space of Munsell, that is, an ideal distortion degree obtained from a sphere has been found out.

Next, the present invention will be specifically described.

In the present invention, lightness $L^*_Y$ is in the range of 80-90, and preferably in the range of 85-90 when a first toner image formed with only a yellow toner exhibits a maximum chroma. Further, lightness $L^*_M$ is in the range of 35-51, and preferably in the range of 40-49 when a second toner image formed with only the magenta toner exhibits a maximum chroma. Further, lightness $L^*_C$ is in the range of 53-70, and preferably in the range of 57-67 when a third toner image formed with only the cyan toner exhibits a maximum chroma.

Further, lightness L* of each monochromatic toner image is defined by L*a*b* color system. "L*a*b* color system" described herein is a means employed to represent color as a numeric value. L* is the coordinate in the z-axis direction to expresses lightness, while a* and b* are coordinates of the x-axis and the y-axe, respectively to express hue and chroma through both of them. In addition, lightness refers to relative chromatic luminosity, while hue refers to color such as red, yellow, green, blue, violet or the like. Chroma refers to a color brightness degree defined by the following equation (1).

That is, chroma C* is expressed as a distance between the foregoing coordinate point (a, b) and origin O, and calculated by the following equation.

$$\text{Chroma } C^* = [(a^*)^2 + (b^*)^2]^{1/2} \qquad \text{Equation (1):}$$

Further, in the case of L*a*b* color system, color tone can be described by the concept such as a hue angle. Herein, hue angle h means an angle made between a half line connecting a certain coordinate point (a, b) to origin O on the x-axis-y-axis plane showing the relationship of hue and chroma when lightness takes a certain value, and a line extending in the + direction (red direction) of x-axis in the counter-clockwise direction from the + direction (red direction) of x-axis, and is calculated by the following Equation (2).

$$\text{Hue angle } h = \tan^{-1}(b^*/a^*) \qquad \text{Equation (2):}$$

In addition, the − (minus) direction of x-axis represented by a* on the x-axis-y-axis plane is the green direction, the + direction of y-axis represented by b* is the yellow direction, and the − (minus) direction of the y-axis is the blue direction.

L*a*b* to determine chroma C* and hue h is specifically measured by a spectrophotometer "Gretag Macbeth Spectrolino" (produced by Gretag Macbeth Co.) Similarly to the measurement of reflection spectra, the measurement is carried out with a D65 light source as a light source, a reflection measuring aperture diameter of 4 mm, 10 nm intervals in the wavelength range to be measured, a visual angle,(observer) of 2°, and a white tile employed for adjustment of the base line.

The maximum chroma of a toner image formed with only yellow toner will be described. In the case of the present invention, the toner image formed with only yellow toner preferably has a maximum chroma $C^*_Y$ of 85-115 in view of secondary color formed with yellow toner, that is, color developing of green and red. Herein, the maximum chroma of a yellow toner monochromatic image is defined as follows.

(1) In the case of a large toner colorant content to be arranged, chroma nearly and proportionally increases with increase of a toner adhesion amount, but when exceeding a certain level, chroma does not increase any more even though the adhesion amount is increased, to such an extent it becomes sluggish, and is eventually to be lowered. When the toner adhesion amount is increased, chroma at a turning point from the increase to the decrease is defined as a maximum chroma in this case.

(2) In the case of the toner adhesion amount being proportional to chroma, chroma of a toner image when the toner adhesion amount to a transfer paper sheet installable in an image forming apparatus is maximized is defined as a maximum chroma in this case. As to the image output, an ECI2002 chart (Random Layout) authorized by ECI (European Color Initiative) can be utilized. In addition, as the transfer paper sheet when measuring chroma and lightness, a transfer paper sheet having a paper weight of 128 g/m$^2$ and a lightness of 93 is employed. For example, "POD GLOSS COAT" paper sheets produced by Oji Paper Co., Ltd. can be utilized. The toner fixing condition means one measured under the standard fixing condition for an image forming apparatus of the present invention. Specifically, a gloss degree of 75° is measured by Gloss Meter (manufactured by Murakami Color Research Laboratory Co., Ltd.), and the gloss degree of a toner image in the image forming apparatus is called one measured with an image having a gloss degree of at least 10.

In addition, the maximum chroma of yellow is one measured at a hue angle of 75°. In this case, as to lightness of a yellow image, lightness $L^*_Y$ is arranged to be in the range of 80-90 when a yellow toner monochromatic image exhibits the maximum chroma, and lightness $L^*_Y$ is arranged to be preferably in the range of 85-90 when a yellow toner monochromatic image exhibits the maximum chroma.

Next, the maximum chroma of a toner image formed with only magenta toner will be described. In the case of the present invention, the toner image formed with only magenta toner preferably has a maximum chroma $C^*_M$ of 70-100 in view of secondary color formed with magenta toner, that is, color developing of blue and red. Herein, the definition of the maximum chroma of a magenta toner monochromatic image is the same definition as described in the yellow toner monochromatic image.

In addition, the maximum chroma of magenta is one measured at a hue angle of 315°. In this case, as to lightness of a magenta image, lightness $L^*_M$ is arranged to be in the range of 35-51 when a magenta toner monochromatic image exhibits the maximum chroma, and lightness $L^*_M$ is arranged to be preferably in the range of 40-49 when a yellow toner monochromatic image exhibits the maximum chroma.

Next, the maximum chroma of a toner image formed with only cyan toner will be described. In the case of the present invention, the toner image formed with only cyan toner preferably has a maximum chroma $C^*_C$ of 50-80 in view of secondary color formed with cyan toner, that is, color developing of green and blue. Herein, the definition of the maximum chroma of a cyan toner monochromatic image is the same definition as described in the yellow toner monochromatic image.

In addition, the maximum chroma of cyan is one measured at a hue angle of 195°. In this case, as to lightness of a cyan image, lightness $L^*_C$ is arranged to be in the range of 53-70 when a cyan toner monochromatic image exhibits the maximum chroma, and lightness $L^*_C$ is arranged to be preferably in the range of 57-67 when a cyan toner monochromatic image exhibits the maximum chroma. In the above-described configurations, granularity and evenness in a secondary color halftone image were largely improved to add appearance of solidity to photographic images, for example, whereby eye-friendly comfortable high quality images were to be produced via addition of the evenness. Further, since an amount of reflected light of an image was increased, the color reproduction region for secondary color was also able to become enlarged. In addition, rich contrast was able to be obtained with respect to dark color formed by superimposing images of yellow, magenta and cyan in addition to black toner by increasing the amount of reflected light of an image.

Next, color tone of yellow toner and lightness adjustment will be described.

In the present invention, when forming a yellow monochromatic image, preferably employed is a yellow toner having a reflectance $A_{415}$ of 7-12% at a wavelength of 415 nm, a reflectance $A_{570}$ of 75-85% at a wavelength of 570 nm, a reflectance $A_{700}$ of 85-95% at a wavelength of 700 nm. When a toner image formed with only the yellow toner exhibits the maximum chroma, lightness $L^*_Y$ can be designed to fall within the range of 80-90 by using the foregoing yellow toner. Further, the reflection spectrum of each monochromatic toner image is measured under the measurement conditions of a D65 light source as a light source, a reflection measuring aperture diameter of 4 mm, 10 nm intervals in the wavelength range to be measured, a visual angle (observer) of 2°, and a white tile employed for adjustment of the base line, employing a spectrophotometer "Gretag Macbeth Spectrolino" (produced by Gretag Macbeth Co.). Reflectance of a yellow toner image, the after-mentioned magenta toner image and a cyan toner image each, a monochromatic image is to be measured via formation of the monochromatic image. First, the image is formed and measured under the condition where an adhesion amount of each color toner on the transfer paper sheet becomes 8.0 g/m$^2$. In this case, as the transfer paper sheet, a transfer paper sheet having a paper weight of 128 g/m$^2$ and a lightness of 93 is employed. For example, "POD GLOSS COAT" paper sheets produced by Oji Paper Co., Ltd. can be utilized. The toner fixing condition means one measured under the standard fixing condition for an image forming apparatus of the present invention. Specifically, a gloss degree of 75° is measured by Gloss Meter (manufactured by Murakami Color Research Laboratory Co., Ltd.), and the gloss degree of a toner image in the image forming apparatus is called one measured with an image having a gloss degree of at least 10.

Specifically, yellow colorant contained in yellow toner is selected from each of the following Group X and Group Y, and the foregoing is attainable by setting the yellow colorant selected from Group X and the other yellow colorant selected from the Group Y to a weight ratio of 65:35-95:5.

Group X: C.I. pigment yellow 3, C.I. pigment yellow 3, C.I. pigment yellow 35, C.I. pigment yellow 65, C.I. pigment yellow 74, C.I. pigment yellow 98 and C.I. pigment yellow 11.

Group Y: C.I. pigment yellow 9, C.I. pigment yellow 36, C.I. pigment yellow 83, C.I. pigment yellow 110, C.I. pigment yellow 139, C.I. pigment yellow 181 and C.I. pigment yellow 153.

Next, color tone of magenta toner and lightness adjustment will be described.

In the present invention, when forming a toner image with only magenta toner, reflected light of the magenta monochromatic image preferably satisfies the following Inequalities (21)-(24). That is, $$30 \leqq B_{450} - B_{520} \leqq 85 \qquad \text{Inequality (21),}$$

wherein $B_{450}$ represents reflectance (unit; %) at a wavelength of 450 nm, and $B_{520}$ represents reflectance (unit; %) at a wavelength of 520 nm.

$$1 \leqq B_{530} - B_{570} \leqq 25 \qquad \text{Inequality (22),}$$

wherein $B_{530}$ represents reflectance (unit; %) at a wavelength of 530 nm, and $B_{570}$ represents reflectance (unit; %) at a wavelength of 570 nm.

$$2 \leqq B_{670} - B_{600} \leqq 50 \quad \text{Inequality (23),}$$

$$80 \leqq B_{670} \quad \text{Inequality (24),}$$

wherein $B_{670}$ represents reflectance (unit; %) at a wavelength of 670 nm, and $B_{600}$ represents reflectance (unit; %) at a wavelength of 600 nm. As a colorant employed for the magenta toner capable of forming a toner image satisfying above-described Inequalities (21)-(24), the following pigments as well as dyes and complex compounds are provided, but a strong bluish magenta colorant can be obtained by mixing a conventional pigment therein in an amount of 1-30%.

Further, specifically, a colorant for the magenta toner to realize the configuration of the present invention can be obtained via mixture of the following dispersion, and by adjusting the reflection spectrum within the range of each of the above-described Inequalities (21)-(24).

Specific examples of the pigment include C.I. Pigment Red 2, C.I. Pigment Red 3, C.I. Pigment Red 6, C.I. Pigment Red 7, C.I. Pigment Red 9, C.I. Pigment Red 15, C.I. Pigment Red 16, C.I. Pigment Red 48:1, C.I. Pigment Red 48:3, C.I. Pigment Red 53:1, C.I. Pigment Red 57:1, C.I. Pigment Red 122, C.I. Pigment Red 123, C.I. Pigment Red 139, C.I Pigment Red 144, C.I. Pigment Red 149, C.I. Pigment Red 166, C.I. Pigment Red 177, C.I. Pigment Red 178, C.I. Pigment Red 208, C.I. Pigment Red 209, C.I. Pigment Red 222 and so forth.

Specific examples of the dye include C.I. Solvent Red 3, C.I. Solvent Red 3, C.I. Solvent Red 14, C.I. Solvent Red 17, C.I. Solvent Red 18, C.I. Solvent Red 22, C.I. Solvent Red 23, C.I. Solvent Red 49, C.I. Solvent Red 51, C.I. Solvent Red 53, C.I. Solvent Red 87, C.I. Solvent Red 3, C.I. Solvent Red 127, C.I. Solvent Red 128, C.I. Solvent Red 131, C.I. Solvent Red 145, C.I. Solvent Red 146, C.I. Solvent Red 149, C.I. Solvent Red 150, C.I. Solvent Red 151, C.I. Solvent Red 152, C.I. Solvent Red 153, C.I. Solvent Red 154, C.I. Solvent Red 155, C.I. Solvent Red 156, C.I. Solvent Red 157, C.I. Solvent Red 158, C.I. Solvent Red 176, C.I. Solvent Red 179 and so forth.

Further, specific examples of the complex compound usable as a magenta colorant include compounds 1-4 as shown below.

Complex compound 1

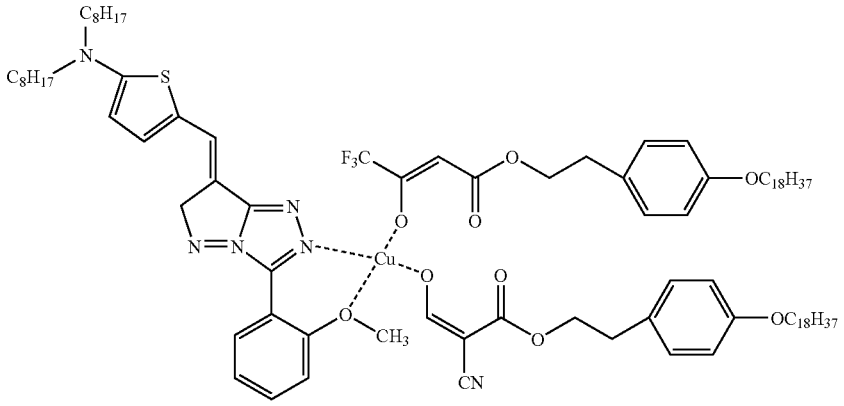

Complex compound 2

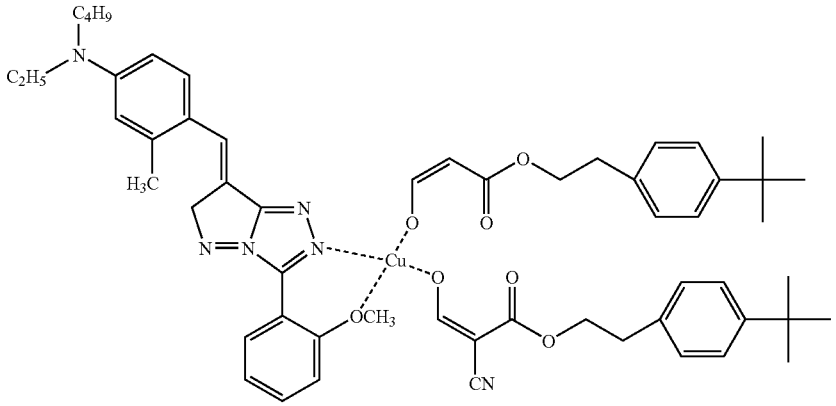

-continued

Complex compound 3

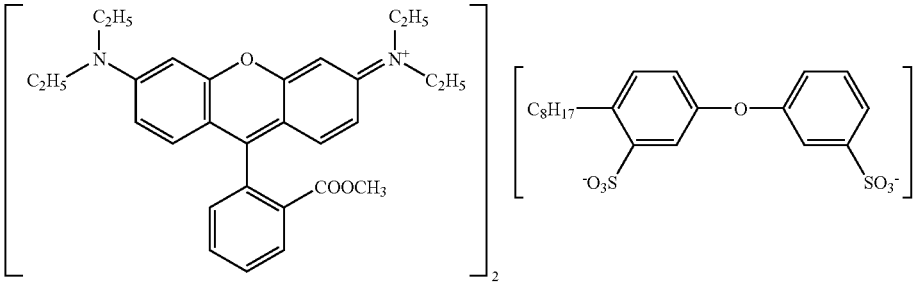

Complex compound 4

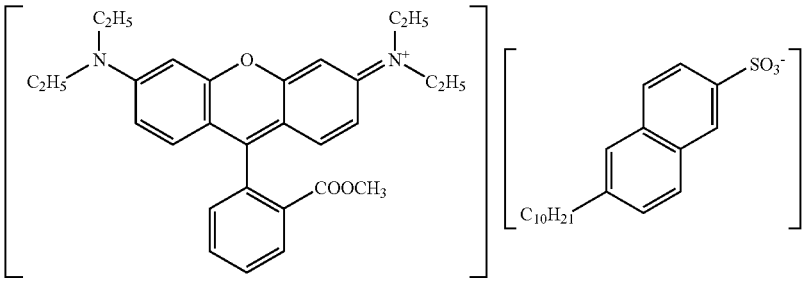

Of these, C.I. Pigment Red 9, C.I. Pigment Red 208, C.I. Pigment Red 209, and complex compounds 1-4 are preferably usable. In the present invention, the above-described colorant is used in combination to obtain a magenta colorant.

Next, color tone of cyan toner and lightness adjustment will be described.

In the present invention, when forming a toner image with only cyan toner, reflected light of the cyan monochromatic image preferably satisfies the following Inequalities (31)-(34). That is, $$4 \leqq |C_{480}-C_{450}| \leqq 16 \quad \text{Inequality (31)}$$

wherein $C_{480}$ represents reflectance (unit; %) at a wavelength of 480 nm, and $C_{450}$ represents reflectance (unit; %) at a wavelength of 450 nm.

$$15 \leqq C_{550}-C_{570} \leqq 35 \quad \text{Inequality (32),}$$

$$20 \leqq C_{570} \leqq 50 \quad \text{Inequality (33),}$$

wherein $C_{550}$ represents reflectance (unit; %) at a wavelength of 550 nm, and $C_{570}$ represents reflectance (unit; %) at a wavelength of 570 nm.

$$0 \leqq C_{620}+C_{650} \leqq 30 \quad \text{Inequality (34),}$$

wherein $C_{620}$ represents reflectance (unit; %) at a wavelength of 620 nm, and $C_{650}$ represents reflectance (unit; %) at a wavelength of 650 nm. As a colorant employed for the cyan toner to form a toner image satisfying above-described Inequalities (31)-(34), the following silicon phthalocyanine compound is typically exemplified. In addition, a colorant employed for cyan toner to form a toner image satisfying the above-described Inequalities (31)-(34) is selected from the following silicon phthalocyanine, and mixed to possibly adjust the spectrum without conducting trial-and-error of those skilled in the art in particular.

Next, the silicon phthalocyanine compound as a colorant preferably usable for cyan toner of the present invention will be described. As one of the cyan toners to produce the effect of the present invention, one possessing a silicon phthalocyanine compound as a colorant, which contains at least a resin and a colorant, wherein the silicon phthalocyanine compound is represented by the following Formula (I). A silicon atom (Si) is utilized as a metal atom (hereinafter, referred to also as a central metal atom) located in the center of a phthalocyanine ring in a silicon phthalocyanine compound represented by Formula (I).

Formula (I)

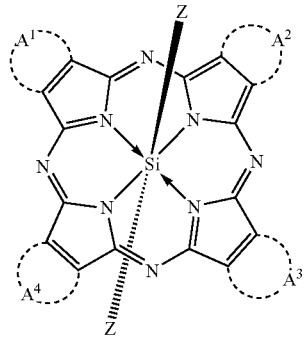

Each Z in Formula (I) independently represents a hydroxy group, chlorine, an aryloxy group having 6-18 carbon atoms, an alkoxy group having 1-22 carbon atoms or a compound represented by the following Formula (IV).

Formula (IV)

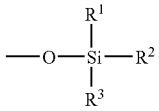

Each of $R_1$, $R_2$ and $R_3$ in Formula (IV) represents an alkyl group having 1-22 carbon atoms, an aryl group having 6-18 carbon atoms, an alkoxy group having 1-22 carbon atoms or an aryloxy group having 6-18 carbon atoms. $R_1$, $R_2$ and $R_3$ may be identical to each other, or may be different from each other. Further, $R_1$, $R_2$ and $R_3$ each represent an alkyl group, an aryl group or an alkoxy group with the above-described carbon atoms, but the number of carbon atoms of these groups each is preferably 1-10, and more preferably 2-8.

Further, each of $A^1$, $A^2$, $A^3$ and $A^4$ in Formula (I) independently represents an atomic group constituting a benzene ring via junction.

A silicon phthalocyanine compound represented by Formula (I) in which a silicon atom is employed as a central metal atom possesses a substituent represented by Z, and is also called a tetraazaporphin based compound. The toner containing a compound represented by Formula (I) can produce higher color reproduction than that of a toner possessing phthalocyanine compound containing no substituent. In this case, by an amount equivalent to a structure of a silicon phthalocyanine compound containing a substituent represented by Formula (I), which is more complicated than that of a silicon phthalocyanine compound containing no substituent, the reason presumably is that coagulation and crystallization are difficult to occur in toner particles. Accordingly, the silicon phthalocyanine compound as a colorant is easy to be evenly dispersed in cyan toner particles or in a fixing image, whereby color reproduction is possibly further improved.

Further, by an amount equivalent to a structure where the phthalocyanine compound is difficult to be coagulated and crystallized, compatibility to a binder resin or solubility to polymerizable monomer in toner is improved, and the phthalocyanine compound is easy to be evenly dispersed in a toner manufacturing process, whereby excellent color reproduction is presumably produced.

As substituent Z constituting a compound represented by Formula (I), a group represented by Formula (IV) is specifically preferable among the foregoing groups. And, each of $R^1$, $R^2$ and $R^3$ in a group represented by Formula (IV) is preferably an alkyl group, an aryl group or an alkoxy group, and more preferably an n-propyl group, an isopropyl group an n-butyl group, an isobutyl group or a t-butyl group. Further, $R^1$, $R^2$ and $R^3$ may be identical to each other, and may be different from each other.

Further, each of $A^1$, $A^2$, $A^3$ and $A^4$ constituting a compound represented by Formula (I) represents an atomic group constituting a benzene ring.

In the case of a cyan toner of the present invention, the above-described phthalocyanine compound is possible to be used singly or in combination with plural kinds. The above-described phthalocyanine compound in the toner may be arranged to have a content of 1-30% by weight, and preferably have a content of 2-20% by weight, based on the total weight of the toner. Specifically, since the above-described compound is expected to exhibit a high molecular extinction property, the effect of the present invention is expected to be possibly produced even in the case of a small addition amount thereof.

Specific examples of the tetraazaporphin compound (a phthalocyanine compound containing a substitute) include those shown in Table 1, but compounds represented by Formula (I), which are usable for the toner of the present invention is not limited to only those shown in Table 1.

TABLE 1

| Compound No. | $A^1$, $A^2$, $A^3$ & $A^4$ | Z |
|---|---|---|
| I-1 | (i) | —O—Si $(CH_2CH_3)_3$ |
| I-2 | (i) | —OH |
| I-3 | (i) | —O—Si $(CH_2CH_2CH_3)_3$ |
| I-4 | (i) | —O—Si $(CH_3)_3$ |

TABLE 1-continued

| Compound No. | $A^1$, $A^2$, $A^3$ & $A^4$ | Z |
|---|---|---|
| I-5 | (i) | —O—Si $(CH(CH_3)_2)_3$ |
| I-6 | (i) | —Cl |
| I-7 | (i) | —OSi $(CH_2CH_2CH_2CH_2CH_2CH_2CH_2CH_3)(CH_3)_2$ |
| I-8 | (i) | —O—Si $(t\text{-}C_4H_9)_3$ |
| I-9 | (ii) | —O—Si $(CH_2CH_3)_3$ |
| I-10 | (iii) | —O—Si $(CH_2CH_3)_3$ |
| I-11 | (iv) | —O—Si $(CH_2CH_3)_3$ |
| I-12 | (i) | —O—Si $(C_{11}H_{23})(CH_3)_2$ |
| I-13 | (i) | —O—Si $(C_{22}H_{45})(CH_2CH_3)(CH_3)$ |
| I-14 | (i) | —O—Si $(CH_2CH_3)(CH_3)(C_6H_5)$ |
| I-15 | (i) | —O—Si $(CH_2CH_3)(CH_3)(C_{18}H_{11})$ |
| I-16 | (i) | —O—Si $(OCH_3)(OC_{22}H_{45})CH_3$ |
| I-17 | (i) | —O—Si $(OC_2H_5)_2(OC_{10}H_{21})$ |
| I-18 | (i) | —O—$CH_3$ |
| I-19 | (i) | —O—$CH_2CH_3$ |
| I-20 | (i) | —O—$CH_2(CH_2)_6CH_3$ |
| I-21 | (i) | —O—$C_{11}H_{23}$ |
| I-22 | (i) | —O—$C_{22}H_{25}$ |
| I-23 | (i) | —$OC_6H_5$(Phenoxy) |
| I-24 | (i) | —$OC_{10}H_7$ (Naphthoxy) |
| I-25 | (i) | —$OC_{14}H_9$ (Anthryloxy) |
| I-26 | (i) | —$OC_{16}H_9$ (Pyrenyloxy) |
| I-27 | (i) | —$OC_{18}H_{11}$ |

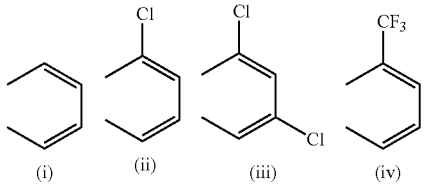

Of these silicon phthalocyanine compounds shown in Table 1, compound I-4 is specifically preferable.

The compound represented by the following Formula (II) is provided as a colorant used in combination with the foregoing silicon phthalocyanine compound in the present invention.

Formula (II)

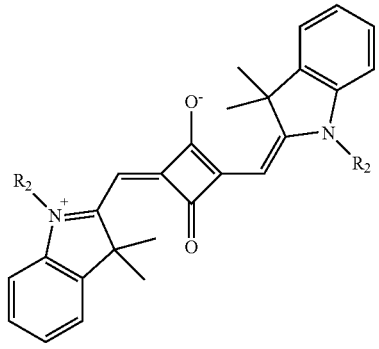

$R_2$ in the above-described structural formula represents a hydrogen atom or an organic group. Further, specific examples of the compound represented by Formula (II), for example, are shown below.

(II-1)

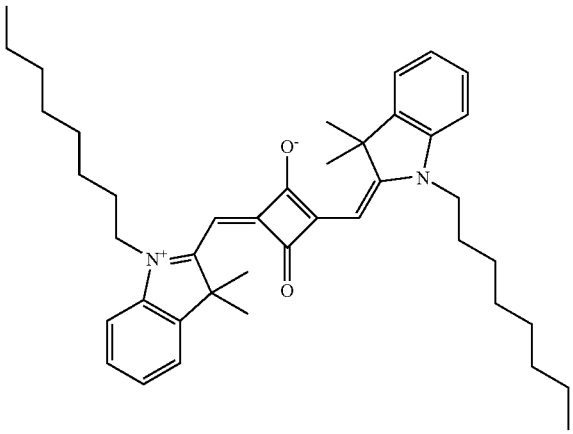

(II-2)

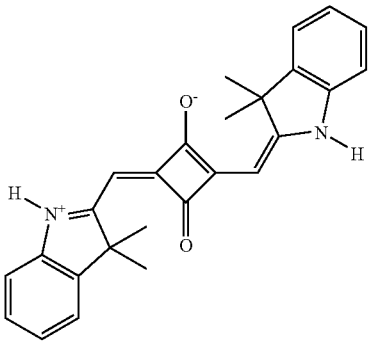

(II-3)

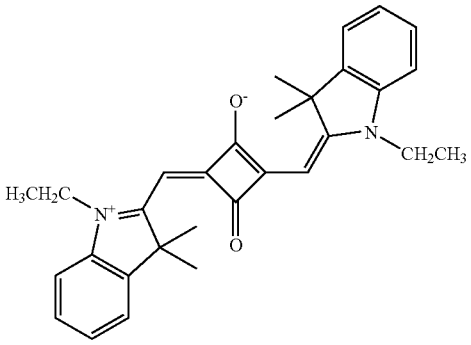

(II-4)

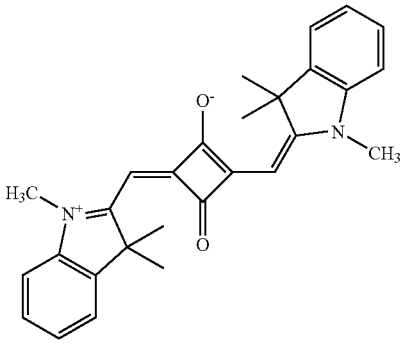

-continued (II-5)

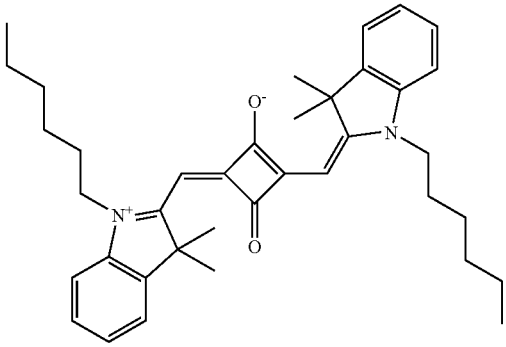

(II-6)

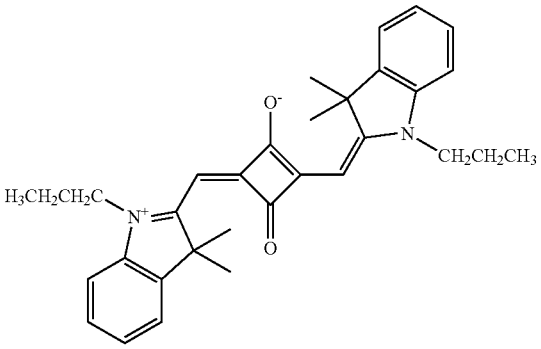

<Softening Point Temperature of Yellow Toner, Magenta Toner and Cyan Toner>

Yellow toner, magenta toner and cyan toner each in the present invention preferably has a softening point temperature of 75-112° C., and more preferably has a softening point temperature of 80-100° C.

By falling the softening point temperature of each of yellow toner, magenta toner and cyan toner within the above-described range, an appropriate melt state of each of yellow toner, magenta toner and cyan can be obtained in a fixing process, whereby excellent color reproduction for the secondary color is to be produced.

"Appropriate melt state of each of yellow toner, magenta toner and cyan toner" described herein is referred to as the state in which when a toner image of another color is superimposed with toner images from yellow toner, magenta toner and cyan toner to form a color image, in the color image region fixed in the state where each of a yellow colorant, a magenta colorant and a cyan colorant contained in the toner image through each of the yellow toner, the magenta toner and the cyan toner, and a magenta dye contained in a toner image through the magenta toner, for example, are subjected to color superposition on a recording material, a yellow colorant and a magenta dye are both evenly dispersed to produce color, and no yellow colorant oozes out up to the region outside the color image region in a state where the interface of the layers made of each of binder resins is eliminated.

The yellow toner of the present invention are employed with magenta toner, cyan toner, black toner and so forth to form a color image. These magenta toner, cyan toner and black toner are preferably designed in such a way that each of these magenta toner, cyan toner and black toner has the same softening point temperature, particle diameter and so forth as those of the yellow toner.

Herein, the softening point temperature of color toner is measured as described below. First, after placing 1.1 g of color toner in a Petri dish to be flattened out, and standing for at least 12 hours at 20° C. and 50% RH, a pressure of 3,820 kg/cm$^2$ is applied for 30 seconds employing a molding machine "SSP-10A" (produced by Shimadzu Corporation) to prepare a 1 cm diameter cylindrical molding sample. Next, the resulting sample is extruded from a cylindrical die hole (1 mm in diameter×1 mm) employing a 1 cm diameter piston after termination of pre-heating under the conditions of an applied load of 196 N (20 kgf), a starting temperature of 60° C., and a temperature raising rate of 6° C./minute, by using a flow tester "CFT-500D" (produced by Shimadzu Corp.) at 24° C. and 50% RH, and offset method temperature $T_{offset}$ measured on the basis of melting temperature determination of the temperature raising method with setting at an offset value of 5 mm is designated as a softening point temperature of the color toner.

The softening point temperature of a binder resin constituting the color toner particle can be adjusted by the molecular weight of the binder resin. In cases where it is a vinyl based copolymer, the molecular weight can be adjusted by an addition amount of a chain transfer agent or a polymerization initiator. Further, resins each having a different molecule or a plurality of resin compositions may coexist. As the high molecular weight, a crosslinking monomer may be added in an amount of 1-10% by weight. Further, in cases where the binder resin is a polyester resin, the molecular weight can be controlled by adjusting a copolymerization ratio of a polycarboxylic acid having at least trivalence and/or polyhydric alcohol having at least trivalence.

<Particle Diameter of Color Toner Particle>

Further, the color toner particle constituting color toner of the present invention preferably has a volume-based median particle diameter of 3.0-10.0 μm, and more preferably has a volume-based median particle diameter of 3.5-8.0 μm. In cases where color toner particles are formed by a polymerization method, the particle diameter of the foregoing toner can be controlled with kinds of dispersants and their addition amount, concentration of a coagulant and an addition amount thereof, coagulation time, and composition of a polymer itself in a method of manufacturing the color toner. On the other hand, in the case of the crushed toner, the adjustment can be made by setting the crushing conditions such as the number of revolution of a crushing rotor or the like, a supplying speed of raw material, and a sorting point, for example.

Granularity of photographic images can be improved, that is, evenness of halftone or the like is increased, whereby subtle color tone such as soft tone or dull tone can also be well exhibited by falling the particle diameter of color toner particles within the above-described range.

The volume-based median particle diameter of color toner is determined and calculated employing a measuring device in which a data processing computer system (produced by Beckman Coulter Inc.) is connected to "COULTER MULTISIZER III" (produced by Beckman Coulter Inc.) Specifically, after 0.02 g of color toner are added into 20 ml of a surfactant solution (a surfactant solution in which a neutral detergent containing a surfactant component is diluted with pure water by a factor of 10 in order to disperse the color toner), and fitted therein, ultrasonic dispersion is carried out for one minute to prepare a color toner dispersion. This color toner dispersion is injected in a beaker on a sample stand, into which "ISOTON II" (produced by Beckman Coulter Inc.) is introduced, employing a pipette until displayed concentration of the measuring device reaches 10%. Herein, reproducible measured values can be obtained by having this concentration. As to the measuring device, the number of measured particle accounts and an aperture diameter are set to 25,000 and 50 μm, respectively, and the particle diameter at 50% from the larger value of the volume integral distribution is designated as a volume-based median particle diameter.

<Average Circularity of Color Toner Particle>

As to the color toner particle of the present invention, the mean value of circularity of each color toner particle constituting this color toner, which is represented by the following equation (3) (hereinafter, referred to as "average circularity") is preferably 0.930-1.000, and more preferably 0.950-0.995 in view of improved transfer efficiency.

Average circularity=Peripheral length of a circle obtained from a circle equivalent diameter/peripheral length of a particle projection image Equation (3):

The color toner particle constituting the color toner of the present invention is preferably composed of a core/shell structure possessing a core particle containing a binder resin and a colorant, and a shell layer made of a shell layer formation resin containing substantially no dye (hereinafter, referred to also as "shell resin"), which covers the circumferential surface of the core particle. In this case, the shell resin contains a different kind of resin from a binder resin constituting the core particle (hereinafter, referred to also as "core binder resin"). Since the color toner particle has a core/shell structure, the color toner particle exhibits high production stability and storage stability.

The color toner particle having a core/shell structure may be one in which the shell layer completely covers the core particle, or one in which the shell layer partly covers the core particle. Further, a part of the shell resin constituting the shell layer may be one in which domains or the like are formed in the core particle. Further, the shell layer may have a multi-layered structure composed of at least two layers each made of a resin having a different composition.

<Method of Manufacturing Color Toner>

As a method of manufacturing color toner of the present invention, listed are a kneading/pulverizing method, a suspension polymerization method, an emulsion polymerization method, an emulsion polymerization coagulation method, a mini-emulsion polymerization coagulation method, an encapsulation method, other commonly known methods, but as a method of manufacturing the color toner, the emulsion polymerization coagulation method is preferably usable in view of production cost and production stability in consideration of being desired to obtain the color toner in which a small particle diameter has been produced in order to achieve high quality of images. The emulsion polymerization coagulation method is a method of manufacturing color toner particles by which a dispersion of particles composed of a binder resin produced by an emulsion polymerization method (hereinafter, referred to also as "binder resin particle") is mixed with a dispersion of a color toner particle constitution component such as other colorant particles; coagulation is slowly conducted while balancing repulsive force of the particle surface via pH adjustment and coagulating force caused by adding a coagulant composed of an electrolyte; association is carried out while controlling an average particle diameter and a particle size distribution; and simultaneously fusion between particles is conducted via heat while stirring to control the shape.

As a method of manufacturing the color toner, binder resin particles to be formed when employing an emulsion polymerization coagulation method may possess a structure having at least two layers each made of a binder resin having a different composition. In this case, a polymerization initiator and a polymerizable monomer are added into the $1^{st}$ resin particle dispersion prepared by an emulsion polymerization treatment (the $1^{st}$ step polymerization) based on a conventional method to employ a polymerization treatment (the $2^{nd}$ step polymerization) for this system.

Further, in the case of a method of manufacturing the color toner particle having a core/shell structure, as detailed later, core particles are first prepared via association, coagulation and fusion for core binder resin particles and colorant particles. Next, shell resin particles to form the shell layer are added in a dispersion of core particles, and the core particle surface is covered by conducting coagulation and fusing of this shell resin particle on the foregoing core particle surface to form a shell layer. Then, the core/shell structure can be obtained via formation of the foregoing shell layer.

The shape of core particles each constituting a toner particle having a core/shell structure can be adjusted by controlling the heating temperature in a coagulation/fusion process, and the heating temperature and a heating duration in the $1^{st}$ ripening process. Specifically, the heating duration in the $1^{st}$ ripening process is controlled to surely adjust circularity of the associated particle.

Then, as to this core particle, for example, preferably usable is the after-mentioned salting-out/fusion method by which polymerizable monomers to form a core binder resin constituting the core particle are mechanically dispersed in an aqueous medium, and colorant particles and core binder resin particles formed via the step of polymerizing polymerizable monomers by a mini-emulsion polymerization method are subjected to salting-out/fusing.

[Binder Resin]

In cases where color toner particles constituting the color toner of the present invention are produced via a pulverization method, a dissolution suspension method or the like, for example, provided are examples of the binder resin constituting the color toner including vinyl based resins such as a styrene based resin, a (meth)acrylic resin, a styrene-(meth) acrylic copolymer resin, an olefin based resins and so forth, and commonly known resins such as a polyester based resin, a polyamide based resin, a polycarbonate resin, a polyether resin, a polyvinyl acetate based resin, a polysulfone resin, an epoxy resin, a polyurethane resin, a urea resin and so forth.

Further, in cases where color toner particles constituting the color toner of the present invention are prepared by a suspension polymerization method, a mini-emulsion polymerization coagulation method, an emulsion polymerization coagulation method or the like, polymerizable monomers to obtain the binder resin constituting the color toner, for example, are listed as follows.

Examples of vinyl based monomers include styrene or a styrene derivative such as styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, or p-n-decylstyrene, p-n-dodecylstyrene or the like; a methacrylic acid ester derivative such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, dimethylaminoethyl methacrylate or dimethylaminoethyl methacrylate; an acrylic acid ester derivative such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate or the like; olefins such as ethylene, propylene or isobutylene; vinyl ester such as vinyl propionate, vinyl acetate, vinyl benzoate or the like; vinyl ether such as vinyl methyl ether, vinyl methyl ether or the like; vinyl ketones such as vinyl methyl ketone, vinyl ethyl ketone or vinyl hexyl ketone; a N-vinyl compound such as N-vinylcarbazole, N-vinylindole, N-vinylpyrrolidone or the like; a vinyl compound such as vinylnaphthalene, vinylpyridine or the like; and an acrylic acid or a methacrylic acid derivative such as acrylonitrile, methacrylonitrile, acrylamide or the like. These vinyl based monomers may be employed individually or in combinations of at least two types.

Further, the polymerizable monomer is preferably used in combination with one having an ionic dissociation group. Examples of the polymerizable monomer having an ionic dissociation group include those having a substituent such as a carboxyl group, a sulfonic acid group, a phosphoric acid group or the like as a constituent group. Specifically, examples thereof include an acrylic acid, a methacrylic acid, a maleic acid, an itaconic acid, a cinnamic acid, a fumaric acid, monoalkyl maleate, monoalkyl itaconate, a styrenesulfonic acid, an allylsulfonic acid, a 2-acrylamido-2-methylpropanesulfonic acid, acid phosphoxyethyl methacrylate, 3-chloro-2-acid phosphoxyethyl methacrylate and so forth.

Further, it is also possible to obtain resins having a crosslinking structure by utilizing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate or the like. Incidentally, resins usable in the present invention include a polyester resin obtained by polycondensation of an acid anhydride or a polyvalent carboxylic acid having at least two carboxyl groups and a polyvalent alcohol having at least two hydroxyl groups. Specific examples of a polyvalent carboxylic acid include aliphatic dicarboxylic acids such as citric acid, malonic acid, maleic acid, fumaric acid, citraconic acid, itaconic acid, glucuronic acid, succinic acid, adipic acid, sebacic acid, n-dodecylsuccinic acid, n-dodecylsuccinic acid and n-dodecenylsuccinic acid; alicyclic dicarboxylic acids such as hexanedicarboxylic acid and aromatic dicarboxylic acids such as phthalic acid, isophthalic acid and terephthalic acid. Specific examples of a polyvalent alcohol include aliphatic diols such as 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; aromatic diols such as an alkylene oxide adduct of bisphenol A; and polyols such as glycerin, pentaerythritol, trimethylolpropane, and sorbitol.

In cases where color toner particles each are composed of a core/shell structure, styrene-acrylic polymer resins are preferable as the core binder resin as well as the shell resin.

In cases where the core binder resin is composed of a copolymer, as a polymerizable monomer to obtain the copolymer, preferably contained is one capable of lowering glass transition temperature (Tg) of the resulting copolymer, such as propyl acrylate, propyl methacrylate, butyl acrylate, butyl methacrylate, 2-ethylhexyl acrylate, 2-ethylhexyl methacrylate or the like.

Such the polymerizable monomer has a copolymer ratio of 8-80% by weight, and preferably has a copolymer ratio of 9-70% by weight, based on the total polymerizable monomer to form the core binder resin.

Such the polymerizable monomer may be one in the form of acid anhydride or a vinylcarboxylic acid metal salt other than the foregoing specific examples.

In cases where the shell resin is composed of a copolymer, as a polymerizable monomer to obtain the copolymer, preferably contained is one capable of lowering glass transition temperature (Tg) of the resulting copolymer, such as styrene, methyl methacrylate, methacrylic acid or the like.

Such the polymerizable monomer has a copolymer ratio of 8-80% by weight, and preferably has a copolymer ratio of 9-20% by weight, based on the total polymerizable monomer to form the shell resin.

Such the polymerizable monomer may be one in the form of acid anhydride or a vinylcarboxylic acid metal salt other than the foregoing specific examples.

As to the binder resin constituting the color toner of the present invention, in cases where the color toner is one having a core/shell structure, which has been prepared by an emulsion polymerization method, a mini-emulsion polymerization coagulation method, an emulsion polymerization coagulation method or the like, for example, a molecular weight of each of binder resins to form a core particle and a shell layer which constitute a color toner particle is preferably as described below. That is, it is preferable that the binder resin constituting the core particle exhibits a peak molecular weight in the range of 5,000-30,000 as weight average molecular weight (Mw) determined via gel permeation chromatography (GPC) for the THF soluble component, and the binder resin constituting the shell layer exhibits a peak molecular weight in the range of 10,000-80,000 as weight average molecular weight (Mw) determined via gel permeation chromatography (GPC) for the THF soluble component. Further, it is more preferable that the binder resin constituting the core particle exhibits a peak molecular weight in the range of 15,000-28,000 as weight average molecular weight (Mw), and the binder resin constituting the shell layer exhibits a peak molecular weight in the range of 10,000-50,000 as weight average molecular weight (Mw).

Further, the binder resin constituting the core particle has a glass transition temperature Tg of 10-50° C., and preferably has a glass transition temperature Tg of 25-48° C. The binder resin constituting the shell layer has a glass transition temperature Tg of 38-64° C., and preferably has a glass transition temperature Tg of 40-54° C.

On the other hand, in cases where the binder resin constituting the above color toner of the present invention is not one having a core/shell structure, it preferably has a number average molecular weight (Mn) of 3,000-6,000 determined by gel permeation chromatography (GPC) for the THF-soluble component, and more preferably has a number average molecular weight (Mn) of 3,500-5,500 determined by gel permeation chromatography (GPC) for the THF-soluble component. A ratio Mw/Mn of weight average molecular weight Mw to number average molecular weight Mn is 2.0-6.0, and is preferably 2.5-5.5. Glass transition temperature Tg is 50-70° C., and is preferably 55-70° C.

Molecular weight measured via GCP is described below. That is, employed are "HLC-8220" (produced by TOSOH Corp.) and a column "TSKguardcolumn+TSKgelSuper HZM-M 3Ren" (produced by TOSOH Corp.). Tetrahydrofuran (THF) as a carrier solvent is allowed to flow at a flow rate of 0.2 ml/min while maintaining the column temperature at 40° C., and a measurement sample is dissolved in tetrahydrofuran at room temperature under the dissolution condition to conduct a treatment for 5 minutes employing an ultrasonic homogenizer so as to reach a concentration of 1 mg/ml. Next, a treatment is carried out employing a 0.2 μm pore size membrane filter to obtain a sample solution, and 10 μl of this sample solution is injected into a device with the above-described carrier solvent to conduct detection employing a refractive index detector (RI detector). The molecular weight distribution of the measurement sample is calculated from a calibration curve which has been prepared by employing monodispersed standard polystyrene particles. As the standard polyethylene sample for calibration curve preparation, employed are those having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, and the calibration curve is prepared via measurements of roughly, at least 10 standard polystyrene samples.

Further, glass transition temperature Tg of the binder resin is measured employing a differential scanning calorimeter "DSC-7" (manufactured by Perkin-Elmer), and a thermal analyzer controller "TAC7/DX" (manufactured by Perkin-Elmer). Specifically, 4.5 mg of color toner are sealed in an aluminum pan "KIT No. 0219-0041", and this is set to a sample holder to use a blank aluminum pan for measurement of the reference. Next, Heat-Cool-Heat temperature control is carried out under the measurement conditions of a measurement temperature of 0-200° C., a temperature increasing rate of 10° C./min, and a temperature decreasing rate of 10° C./min to obtain data in the 2nd heating. Then, the intersection of the extension of the base line prior to the rise of the first endothermic peak with the tangent exhibiting the maximam slope between the rising position of the first endothermic peak and the peak is designated as glass transition temperature Tg. In addition, n the case of temperature increase of the first Heat, 200° C. is maintained for 5 minutes.

Further, the softening point temperature of the binder resin relating to the color toner as described above may be the temperature of which the softening point temperature of the resulting color toner falls within the range.

The color toner of the present invention having a core/shell structure is specifically prepared via the following processes:

Colorant particle dispersion preparation process (1) by which a dispersion of colorant particles obtained by dispersing the colorant in the form of particles is prepared; core binder resin particle polymerization process (2-1) by which this dispersion is prepared via acquisition of binder resin particles made of a core binder resin containing a releasing agent, a charge control agent or the like, if desired; shell resin particle polymerization process (2-2) by which this resin particle is prepared via acquisition of resin particles made of a shell resin; coagulation/fusion process (3) by which associated particles to produce core particles are formed via coagulation and fusion of core binder resin particles and colorant particles in an aqueous medium; first ripening process (4) by which core particles are obtained via adjustment of the shape by thermally ripening the associated particles; shell layer formation process (5) by which particles having a core/shell structure are formed via coagulation and fusion of the shell resin particle on the core particle surface by adding the shell resin particle to form the shell layer in a dispersion of the core particle dispersion; second ripening process (6) by which the colored particle having a core/shell structure via adjustment of the shape by thermally ripening particles having a core/shell structure with thermal energy; filtration/washing process (7) by which surfactants and so forth are removed from the colored particles via solid-liquid separation of the colored particles from a dispersion system of the cooled colored particles (aqueous medium); and drying process (8) by which dries the colored particles having been subjected to the washing process are dried. After conducting the drying process, if desired, added may be external additive treatment process (9) by which yellow toner particles are obtained via addition of external additives into the colored particles having been subjected to the drying treatment.

Next, each process of manufacturing toner to obtain the yellow toner having a core/shell structure will be described.

(1) Colorant Particle Dispersion Preparation Process

In this process, a treatment of preparing a dispersion of colorant particles in which colorants are dispersed in the form of particles is conducted by adding colorants in an aqueous medium to be dispersed by a homogenizer. Specifically, as described later, a dispersion treatment of the colorants is conducted in an aqueous medium in such a state where concentration of the surfactant exceeds the critical micelle concentration (CMC). Homogenizers employed for the dispersion treatment are not specifically limited, but preferably listed are pressure-application type homogenizers such as an ultrasonic homogenizer, a mechanical homogenizer, Manton Gaulin, a pressure system homogenizer and so forth, and medium type homogenizers such as a sand grinder, a Getzmann mill, a diamond fine mill and so forth.

The colorant particles in this colorant particle dispersion preferably have a volume-based median diameter of 40-200 nm as a dispersion diameter.

(2-1) Core Binder Resin Particle Polymerization Process

In this process, a polymerization treatment is conducted to conduct a treatment by which a dispersion of binder resin particles made of the core binder resin containing a releasing agent, a charge control agent or the like, if desired, is prepared.

An appropriate example of a polymerization treatment in this process is as follows. A polymerizable monomer solution containing a releasing agent, a charge control agent and so forth, if desired, is added into an aqueous medium containing a surfactant having critical micelle concentration (CMC) or less to form liquid droplets by applying mechanical energy, followed by addition of a water-soluble polymerization initiator, whereby polymerization reaction is conducted in the liquid droplets. In addition, an oil-soluble polymerization initiator may be contained in the foregoing liquid droplets. In such the process, an emulsification treatment (formation of liquid droplets) is forcibly conducted via application of mechanical energy. Listed as such mechanical energy application means may be those such as a homomixer, an ultrasonic homogenizer, or a Manton-Gaulin homogenizer, which can provide strong agitation or ultrasonic vibration energy.

Surfactants employed in an aqueous medium used during polymerization of the above-described particles and core binder resin particles will be described here.

The foregoing surfactants are not specifically limited, but preferably usable examples of ionic surfactants include sulfonic acid salts (sodium dodecylbenzenesulfonate, sodium arylalkyl polyethersulfonate and so forth); sulfuric acid ester salts (sodium dodecylsulfate, sodium tetradecylsulfate, sodium pentadecylsulfate, sodium octylsulfate and so forth); and fatty acid salts (sodium oleate, sodium laureate, sodium caprate, sodium caprylate, sodium caproate, potassium stearate, calcium oleate and so forth). Further, usable examples of nonionic surfactants include polyethylene oxide, polypropylene oxide, and a combination of polypropylene oxide with polyethylene oxide, ester of polyethylene glycol with a higher fatty acid, alkylphenol polyethylene oxide, ester of a higher fatty acid with polyethylene glycol, ester of a higher fatty acid with polypropylene oxide, sorbitan ester and so forth.

Next, a polymerization initiator, a chain transfer agent and a charge control agent to be used in a core binder resin particle polymerization process will be described.

(Polymerization Initiator)

Examples of the foregoing water-soluble polymerization initiators include persulfates such as potassium persulfate, ammonium persulfate and so forth, azobisaminodipropane acetate, an azobiscyanovaleric acid and a salt thereof, and hydrogen peroxide.

Further listed as oil-soluble radical polymerization initiators may be azo based or diazo based polymerization initiators such as 2,2'-azobis-(2,4-dimethylvaleronitrile), 2,2'-azobisbutyronitrile, 1,1'-azobis(cyclohexane-1-carbonitrile), 2,2'-azobis-4-methoxy-2,4-dimethylvaleronitrile, or azobisisobutyronitrile, as well as peroxide based polymerization initiators and polymer initiators each having a peroxide in the side chain such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, tris-(t-butylperoxy)triazine and so forth.

(Chain Transfer Agent)

In this polymerization process, in order to adjust the molecular weight of the resulting core binder resin, commonly known chain transfer agents are usable. Chain transfer agents are not specifically limited, but usable examples thereof include mercaptan such as n-octylmercaptan, n-decylmercaptan or tert-dodecylmercaptan; mercaptopropionic acid ester such as n-octyl-3-mercaptopropionic acid ester and so forth; terpinolane; α-methylstyrene dimmers and so forth.

(Releasing Agent)

A releasing agent contributing to prevention of an offsetting phenomenon may be contained in the color toner particle constituting color toner of the present invention. Releasing agents are not specifically limited, and examples thereof include polyethylene wax, oxidation type polyethylene wax, polypropylene wax, oxidation type polypropylene wax, carnauba wax, sazol wax, rice wax, candelilla wax and so forth.

The releasing agent in the color toner particle commonly has a content of 0.5-5 parts by weight with respect to 100 parts by weight of the binder resin, and preferably has a content of 1-3 parts by weight with respect to 100 parts by weight of the binder resin. In the case of the releasing agent having less than 0.5 parts by weight with respect to 100 parts by weight of the binder resin, no sufficient offset prevention effect is realized, while when it exceeds 5 parts by weight with respect to 100 parts by weight of the binder resin, transparency and color reproduction of the resulting color toner are degraded.

(Charge Control Agent)

A charge control agent may be contained in the color toner particle constituting color toner of the present invention, if desired. As the charge control agent, various kinds of compounds can be utilized In this process, produced may be one containing a colorant as the core binder resin particle. The core binder resin particle colored with a colorant is obtained by polymerizing a polymerizable monomer composition containing the colorant. When core binder resin particles having been previously colored with the colorant, colored core particles can be obtained by coagulating the colored core particles in coagulation/fusion process of (3) without conducting colorant particle dispersion preparation process of (1).

(2-2) Shell Resin Particle Polymerization Process

In this process, a polymerization treatment is conducted similarly to the core binder resin particle polymerization process in the above-described (2-1), and a treatment to prepare a shell resin particle dispersion composed of a shell resin is conducted.

(3) Coagulation/Fusion Process

This process is a process in which core binder resin particles and colorant particles are coagulated and fused in an aqueous medium to form associated particles which produce core particles. As a coagulation/fusion method in this process, preferable is a salting-out/fusion process employing colorant particles obtained via a colorant particle dispersion preparation process in (1) and core binder resin particles obtained via a core binder resin particle polymerization process in (2-1). Further, internal additive particles such as releasing agent particles and a charge control agent, together with core binder resin particles and colorant particles can be coagulated and fused in the coagulation/fusion process.

"Salting-out/fusing" herein means that a process in which coagulation and fusion are carried out in parallel, and when particles are grown to the predetermined particle diameter, particle growth is terminated via addition of a coagulation termination agent, followed by heating conducted continuously in order to control particle shape, if desired.

A salting-out/fusing method is described as follows. A salting-out agent containing an alkaline metal salt, an alkaline earth metal salt and a trivalent salt are added into an aqueous medium in which core binder resin particles and colorant particles are present as a coagulant having a concentration of at least the critical coagulation concentration. Next, heating is conducted at at least the glass transition temperature of the foregoing core binder resin particles, and also at at least the melting peak temperature (° C.) of the core binder resin particles with colorant particles to accelerate salting-out, whereby coagulation/fusion is simultaneously carried out. Concerning alkaline metal salts and alkaline earth metal salts as the salting-out agent, examples of alkaline metals include lithium, potassium, sodium and so forth, and examples of alkaline earth metals include magnesium, calcium, strontium, barium and so forth. Of these, potassium, sodium, magnesium, calcium, and barium are preferable.

When a coagulation/fusion process is conducted via salting-out/fusing, it is preferable to have a standing duration after addition of a salting-out agent as shortly as possible. The reason is unknown, but produced is a problem such that the coagulation state of particles varies, the particle size distribution becomes unstable, and the surface properties of fused toner varies, depending on the standing duration after salting-out. Further, the temperature during addition of a salting-out agent is desired to be at most the glass transition temperature of core binder resin particles. The reason for this is that when the temperature during addition of a salting-out agent is at least the glass transition temperature of core binder resin particles, salting-out/fusing of the core binder resin particles proceeds quickly, but there appears a problem such that large diameter particles are to be generated since no particle diameter can be controlled. The range of temperature for this addition may be at most the glass transition temperature of the resin, but it is commonly 5-55° C., and is preferably 10-45° C.

Further, a salting-out agent is added at the glass transition temperature of the core binder resin particles or less. Thereafter, the temperature is increased as quickly as possible, to the glass transition temperature of the core binder resin particles or more and the melt peak temperature (° C.) of the core binder resin particles with the colorant particles or more. The duration up to this temperature increase is preferably less than one hour. Further, though it is desired to quickly increase the temperature, the rate of temperature increase is preferably at least 0.25° C./min. The upper limit is not clear, but when the temperature is increased instantaneously, salting-out proceeds rapidly, whereby produced is a problem in which it is difficult to control the particle diameter. Thus, at most 5° C./min is preferred. By the above-described salting-out/fusing method, obtained is a dispersion of associated particles (core particles) produced via salting-out/fusing of core binder resin particles with any of particles.

Further, "aqueous medium" means a medium composed of 50-100% by weight of water and 0-50% by weight of a water-soluble organic solvent. Examples of the water-soluble organic solvent include methanol, ethanol, isopropanol, butanol, acetone, methyl ethyl ketone and tetrahydrofuran. Of these, the alcohol based organic solvent which does not dissolve the resulting resin is preferable.

(4) First Ripening Process

In this process, associated particles are subjected to ripening via heat energy to conduct a ripening treatment.

Further, by adjusting heating temperature of a coagulation•fusion process and specifically by adjusting heating temperature and time of the first ripening process, controlling can be conducted in such a way that the surface of the resulting core particle having a constant particle diameter as well as a narrow distribution is smooth, but the particle size becomes even. Specifically, in the coagulation•fusion process, heating temperature is adjusted to be low to inhibit progress of the fusion of core binder resin particle-to-core binder resin particle, whereby the evenness is accelerated. Thus, controlling to have the core particle surface being even in shape is conducted in such a way that heating temperature is adjusted to be relatively low in the first ripening process, and time is adjusted to be longer.

(5) Shell Layer Formation Process

In the shell layer formation process, a shell resin particle dispersion is added into a core particle dispersion to coagulate and fuse shell resin particles on the surface of the core particle, and the shell resin particle is coated onto the core particle surface to conduct a shell formation treatment to form particles having a core/shell structure.

This shell layer formation process is of the preferable manufacturing condition in order to provide both properties of low temperature fixability and heat-resistant storage. Further, when color images are to be formed, it is preferable to utilize this shell layer formation process in order to obtain high color reproduction for the secondary color.

Specifically, the core particle dispersion is placed in a state where heating temperature is maintained in the above-described coagulation/fusion process and the first ripening process to add a shell resin particle dispersion, and the shell resin particle is slowly coated on the core particle surface while continuously stirring with heat spending time to form particles having a core/shell structure. The stirring time with heat is preferably 1-7 hours, and is more preferably 3-5 hours.

(6) Second Ripening Process

When the diameter of particles each having a core/shell structure reaches the predetermined diameter via shell layer formation process, a terminator such as sodium chloride or the like is added to stop particle growth, and then heating while stirring is continuously conducted for several hours in order to coagulate shell resin particles attached onto the core particles. Thickness of a layer made of a shell resin to coat the surface of the core particle is set to 100-300 nm. In this way, resin particles adhere onto the core particle surface to form a shell layer, whereby rounded colored particles each having a core/shell structure, which is even in shape, are formed.

In a method of manufacturing the color toner of the present invention, it is possible to control shape of the colored particle so as to make the shape to be spherical by setting the duration of the second ripening process to be longer or setting the ripening temperature to high temperature.

(7) Filtration and Washing Process

In this process, first, the above-described colored particle dispersion is subjected to a cooling treatment. As the cooling treatment condition, cooling is preferably carried at a cooling rate of 1-20° C./minute. The cooling treatment method is not specifically limited, and exemplified may be a method in which cooling is carried out via introduction of a cooling medium from the outside of a reaction vessel, and a method in which cooling is carried out via directly charging of cooled water into a reaction system.

Next, colored particles are subjected to solid/liquid separation from the colored particle dispersion having been cooled to the predetermined temperature. Thereafter, conducted is a washing treatment by which attached materials such as a surfactant, a salting-out agent or the like is removed from a toner cake having been subjected to solid/liquid separation (an aggregated substance obtained by coagulating a wet state colored particles in the form of a cake). Examples of the filtration treatment method include a centrifugal separation method, a method of filtering under reduced pressure using a Nutsche funnel or the like, a method of filtering using a filter press or the like, and so forth, but the present invention is not specifically limited thereto.

(8) Drying Process:

In this process, the washed toner cake is subjected to a drying treatment to obtain dried colored particles. Drying machines usable in this step include, for example, a spray dryer, a vacuum freeze-drying machine, or a vacuum dryer. Preferably used are a standing plate type dryer, a movable plate type dryer, a fluidized-bed dryer, a rotary dryer or a stirring dryer. The moisture content of the toner particles having been subjected to a drying treatment is preferably not more than 5% by weight, and more preferably not more than 2% by weight. When toner particles that were subjected to a drying treatment are aggregated via a weak attractive force between particles, the aggregate may be subjected to a pulverization treatment. Pulverization can be conducted using a mechanical pulverizing device such as a jet mill, a Henschel mixer, a coffee mill or a food processor.

(9) External Additive Addition Treatment Process:

Colored particles as the color toner of the present invention can constitute color toner particles on their own, but color toner particles are produced by adding so-called external additives in order to improve fluidity, electrification and a cleaning property. These external additives are not specifically limited, and various inorganic and organic particles, and aliphatic metal salts are usable.

As the above-described inorganic particles, inorganic oxide particles such as silica particles, titania particles, or alumina particles are preferably employed, and these inorganic particles are preferably subjected to a hydrophobization treatment with a silane coupling agent, a titanium coupling agent or the like.

Further as organic particles, spherical ones having a number average primary particle diameter of about 10- about 2,000 nm can be utilized. Usable examples of these organic particles include those composed of polystyrene, polymethyl methacrylate or a styrene-methyl methacrylate copolymer.

The added content of these external additives in the color toner is 0.1-5.0% by weight, and preferably 0.5-4.0% by weight. Further, the external additives may be used in combination with various kinds.

[Recording Material]

The recording material usable for a full-color image forming method of the present invention is a support capable of keeping the color toner image. Specific examples of various types of the recording material include plain paper from thin paper to thick paper; fine-quality paper; printing paper such as art paper and coated paper; commercially available Japanese paper and postcard paper; plastic film for OHP; and cloth, but the present invention is not limited thereto.

[Developer]

The color toner usable for the present invention may be used as a nonmagnetic single component developer, but is also usable as a two-component developer via mixture with a carrier. In cases where the forgoing color toner is used as a two-component developer, magnetic particles composed of commonly known materials such as metal like iron, ferrite or magnetite, or alloys of the foregoing metals and metal like aluminum or lead are usable as a carrier. Of these, ferrite particles are specifically preferable. Further, a coat carrier obtained by coating the magnetic particle surface with a coating agent and a binder type carrier formed by dispersing magnetic powder in a binder resin are also usable as the carrier.

The coating resin constituting the coat carrier is not specifically limited, and examples thereof include a polyolefin based resin, a polystyrene based resin, a styrene-acryl based copolymer resin, silicone based resin, a polyester resin, a fluorine-containing resin and so forth. The binder resin constituting the binder type carrier are not specifically limited, and commonly known resins are usable, such as a styrene-acryl based copolymer resin, a polyester resin, a fluorine resin, phenol resin and so forth.

The carrier preferably has a volume-based particle median particle diameter of 20-100 μm, and more preferably has a volume-based median particle diameter of 20-60 μm in order to obtain high quality image and to inhibit carrier fog. The volume-based median particle diameter of the carrier can be determined employing a laser diffraction type particle size distribution measurement apparatus equipped with a wet disperser, HELOS (manufactured by SYMPATEC Corp.).

In view of spent resistance, listed as preferable carriers are coated carriers employing as coating resins, silicone based resins, copolymer resins (graft resins) of organopolysiloxane with vinyl based monomers, or polyester resins. In view of durability, stability against environment, and spent resistance, preferably listed are carriers which are covered by the resins which are prepared by allowing copolymer resins (or graft resins) of organopolysiloxane with vinyl based monomers to react with isocyanate. The vinyl based monomer to form the above-described coat carrier is a monomer having a substituent such as a hydroxyl group or the like exhibiting reactivity with isocyanate.

Next, an example of an image forming apparatus to realize a full-color image forming method of the present invention will be described. FIG. 1 is a schematic diagram showing an example of an image forming apparatus capable of forming full-color images with a two-component developer. In FIG. 1, 1Y, 1M, 1C and 1K each represent a photoreceptor, 4Y, 4M, 4C and 4K each represent a developing device (developing means), 5Y, 5M, 5C and 5K each represent a primary transfer roll as a primary transfer device, 5A represents a secondary transfer roll as a secondary transfer device, 6Y, 6M, 6C and 6K each represent a cleaning device, 7 represents an intermediate transfer member unit, 24 represents a heat-roll fixing device, and 70 represents an intermediate transfer member.

This image forming apparatus called a tandem type color image forming apparatus comprises a plurality of image forming sections 10Y, 10M, 10C, and 10K, endless-belt-shaped intermediate transfer member unit 7, endless-belt-shaped sheet convey device 21 to convey recording member P, and heat-roll type fixing device 24 as fixing device 24. Document image reading device SC is placed on main body A of the image forming apparatus.

Image forming section 10Y to form the yellow image as one toner image out of different colors formed on each photoreceptor comprises drum-shaped photoreceptor 1Y as the first photoreceptor, charging device 2Y placed around photoreceptor 1Y, exposure device 3Y, developing device 4Y, primary transfer roll 5Y as a primary transfer device, and cleaning device 6Y. Further, image forming section 10M to form the magenta image as one toner image of another different color comprises drum-shaped photoreceptor 1M as the first photoreceptor, charging device 2M placed around the photoreceptor 1M, exposure device 3M, developing device 4M, primary transfer roll 5M as a primary transfer device, and cleaning device 6M. Further, image forming section 10C to form the cyan image as one toner image of another different color comprises drum-shaped photoreceptor 1C as the first photoreceptor, charging device 2C placed around photoreceptor 1C, exposure device 3C, developing device 4C, primary transfer roll 5C as a primary transfer device, and cleaning device 6C.

Further, image forming section 10K to form the black image as one toner image of another different color comprises drum-shaped photoreceptor 1K as the first photoreceptor, charging device 2K placed around photoreceptor 1K, exposure device 3K, developing device 4K, primary transfer roll 5K as a primary transfer device, and cleaning device 6K.

Endless-belt-shaped intermediate transfer member unit 7 is windingly wound with a plurality of rollers, and has endless-belt-shaped intermediate transfer member 70 as an intermediate transfer endless-belt-shaped second image carrier which is rotatably supported.

Color images formed by image forming sections 10Y, 10M, 10C, and 10K each are sequentially transferred onto rotating endless-belt-shaped intermediate transfer belt 70 by primary transfer rolls 5Y, 5M, 5C and 5K, so that a composite color image is formed. Recording member P of a sheet as a transfer material received in sheet feeding cassette 20 is fed by sheet feeding device 21, conveyed to secondary transfer roller 5A as a secondary transfer device through a plurality of intermediate rolls 22A, 22B, 22C, 22D, and registration roller 23, and then, the color image is secondarily transferred all at once onto transfer material P. Recording member P on which the color image has been transferred is fixed by heat-roll type fixing device 24, sandwiched by paper-ejection roll 25, and mounted on paper-ejection tray 26 outside the machine.

On the other hand, after the color image has been transferred onto recording member P by secondary transfer roll, 5A, residual toner is removed from endless-belt-shaped intermediate transfer member 70, from which transfer material P has self-striped, with cleaning device 6A.

During image forming processing, primary transfer roll 5K is constantly pressed against photoreceptor 1K. Other primary transfer rolls 5Y, 5M, and 5C are pressed against photoreceptors 1Y, 1M, and 1C, respectively only during color image formation.

Secondary transfer roll 5A is pressed against endless-belt-shaped intermediate transfer member 70 only when recording member P passes through here and the secondary transfer is carried out.

In this way, toner images are formed on photoreceptors 1Y, 1M, 1C and 1K via electrification, exposure and development, toner images of each color are superimposed on endless-belt-shaped intermediate transfer member 70 to be transferred all at once onto recording member P, and to be subsequently fixed via applied pressure and heating with fixing device 24. As to photoreceptors 1Y, 1M, 1C and 1K after transferring toner images into recording member P, the toner remaining on the photoreceptors is removed during transfer employing cleaning device 6A, and then, a cycle of the above-described electrification, exposure and development is subsequently carried out to conduct the next image formation.

A full-color image forming method employing a nonmagnetic single-component developer is possible to be realized by utilizing an image forming apparatus in which developing device 4 for the foregoing two-component developer is replaced by a developing device for the commonly known nonmagnetic single-component developer.

Further, a fixing process available for an image forming method of the present invention is not specifically limited, and a commonly known fixing system can be utilized. Examples of the commonly known fixing system include a roller fixing system composed of a heat roller and an applied pressure roller, a fixing system composed of a heat roller and an applied pressure belt, a fixing system composed of a heat belt and an applied pressure roller, a belt fixing system composed of a heat belt and an applied pressure belt and so forth. Any of the fixing systems may be utilized. Further, examples of the heating system include a halogen lamp system, an IH fixing system and so forth. Any of the commonly known heating systems can be utilized.

EXAMPLE

Next, embodiments of the present invention will now be specifically described referring to examples, but the present invention is not limited thereto. The volume-based median diameter of yellow colorant particles was determined via "MICROTRAC UPA 150" (manufactured by Honeywell Co.) under the following measurement conditions.

[Measurement Condition]

Transparency: Yes
Refractive index: 1.59
Particle density: 1.05 g/cm$^3$
Spherical particle: Yes
(Solvent Condition)
Refractive index: 1.33
Viscosity: $0.797\times10^{-3}$ Pa·S at high temperature
$1.002\times10^{-3}$ Pa·S at low temperature 1. Preparation of "Yellow Colorant Particle Dispersions 1-20"

(1) Preparation of "Yellow Colorant Particle Dispersion 1"

A solution in which 11.5 parts by weight of sodium n-dodecylsulfate were dissolved in 160 parts by weight of ion-exchanged water while stirring, and the following yellow colorant was gradually added into the foregoing solution.

| | |
|---|---|
| C.I. Pigment Yellow 74 | 22.5 parts by weight |
| C.I. Pigment Yellow 83 | 2.5 parts by weight |

Next, a dispersion treatment was conducted employing a homogenizer "CLEARMIX W MOTION CLM-0.8" (manufactured by M Technique Co.) to prepare "yellow colorant particle dispersion 1" having a volume-based median particle diameter of 126 nm.

(2) Preparation of "Yellow colorant particle dispersions 2-20"

"Yellow colorant particle dispersions 2-20" were prepared similarly to preparation of "yellow colorant particle dispersion 1", except that yellow colorant kind and the addition amount were replaced by those described in Table 2.

TABLE 2

| Pigment for yellow colorant | | |
|---|---|---|
| Y1 | Y2 | |
| Addition amount | Addition Amount | Weight |

| *1 | Kind | (Parts by weight) | Kind | (Parts by weight) | ratio Y1:Y2 | Remarks |
|---|---|---|---|---|---|---|
| 1 | P.Y.74 | 22.5 | P.Y.139 | 2.5 | 90:10 | Inv. |
| 2 | P.Y.74 | 17.0 | P.Y.139 | 8.0 | 68:32 | Comp. |
| 3 | P.Y.74 | 15.0 | P.Y.83 | 10.0 | 60:40 | Comp. |
| 4 | P.Y.74 | 20.0 | P.Y.36 | 5.0 | 80:20 | Inv. |
| 5 | P.Y.65 | 23.75 | P.Y.36 | 1.25 | 95:5 | Inv. |
| 6 | P.Y.98 | 22.5 | P.Y.36 | 2.5 | 90:10 | Inv. |
| 7 | P.Y.3 | 22.5 | P.Y.181 | 2.5 | 90:10 | Inv. |
| 8 | P.Y.3 | 17.5 | P.Y.153 | 7.5 | 70:30 | Comp. |
| 9 | P.Y.3 | 23.75 | P.R.9 | 1.25 | 95:5 | Comp. |
| 10 | P.Y.111 | 19.5 | P.Y.153 | 5.5 | 78:22 | Inv. |
| 11 | P.Y.111 | 17.0 | P.Y.153 | 8.0 | 68:32 | Inv. |
| 12 | P.Y.35 | 20.0 | P.Y.36 | 5.0 | 80:20 | Inv. |
| 13 | P.Y.74 | 6.25 | P.Y.36 | 18.75 | 25:75 | Comp. |
| 14 | P.Y.74 | 2.5 | P.Y.36 | 22.5 | 10:90 | Comp. |
| 15 | P.Y.111 | 22.5 | P.Y.153 | 2.5 | 90:10 | Inv. |
| 16 | P.Y.35 | 18.0 | P.Y.36 | 7.0 | 78:22 | Inv. |
| 17 | P.Y.35 | 15.0 | P.Y.36 | 10.0 | 60:40 | Inv. |
| 18 | P.Y.3 | 17.5 | P.Y.74 | 7.5 | 70:30 | Inv. |
| 19 | P.Y.3 | 12.5 | P.Y.74 | 12.5 | 50:50 | Inv. |
| 20 | P.Y.74 | 17.5 | P.Y.110 | 7.5 | 70:30 | Inv. |

*1: Yellow colorant particle dispersion No.
P.Y.: Pigment yellow
P.R.: Pigment red
Inv.: Present invention
Comp.: Comparative example 2. Preparation of "Yellow Toners 1-20"

2-1. Preparation of "Core Formation Resin Particle A"

(Preparation of "Core Formation Resin Particle A")

"Core formation resin particle A" was prepared by the following procedures.

(1) 1$^{st}$ Step Polymerization

A surfactant solution in which 4 parts by weight of an anionic surfactant represented by the following structural formula 1 was dissolved in 3040 parts by weight of ion-exchange water was charged in a reaction vessel fitted with a stirrer, a thermal sensor, a cooling pipe and a nitrogen introducing device, and the internal temperature of the system was increased to 80° C. while stirring at a stirring speed of 230 rpm under nitrogen flow.

$$C_{10}H_{21}(OCH_2CH_2)_2SO_3Na \quad \text{(Structural formula 1)}$$

An initiator solution in which 10 parts by weight of a polymerization initiator (potassium persulfate: KPS) was dissolved in 400 parts by weight of ion-exchange water was added into the above-described surfactant solution, and heated up to 75° C., a monomer mixture solution containing the following compounds was dripped into the reacting vessel spending one hour.

| | |
|---|---|
| Styrene | 532 parts by weight |
| n-butyl acrylate | 200 parts by weight |
| Methacrylic acid | 68 parts by weight |
| n-octyl mercaptan | 16.4 parts by weight |

After dropping the foregoing monomer mixture solution, this system was heated at 75° C. for 2 hours, polymerization was conducted while stirring (the 1$^{st}$ step polymerization) to prepare resin particles. This is designated as "resin particle A1".

(2) 2$^{nd}$ Step Polymerization (Formation of Intermediate Layer)

The following compounds were added into a flask fitted with a stirring device to prepare a monomer mixture solution, and the following releasing agent was added into the foregoing monomer mixture solution.

| | |
|---|---|
| Styrene | 101.1 parts by weight |
| n-butyl acrylate | 62.2 parts by weight |
| Methacrylic acid | 12.3 parts by weight |
| n-octylmercaptan | 1.75 parts by weight |

Subsequently, 93.8 parts by weight of paraffin wax "HNP-57" (produced by Nippon Seiro Co., Ltd.) were dissolved via heat at 80° C. to prepare a monomer solution.

On the other hand, a surfactant solution in which 3 parts by weight of an anionic surfactant represented by the above-described structural formula 1 was dissolved in 1560 parts by weight of ion-exchange water was heated to 80° C., and 32.8 parts by weight of a dispersion of the foregoing "resin particle A1" in terms of the solid content conversion were added into this surfactant solution. After the addition, a monomer solution in which the foregoing releasing agent was dissolved was mixed and dispersed for 8 hours by a mechanical dispersion apparatus "CLEAR MIX" (manufactured by M Technique Co.) equipped with a circulation pass to prepare a dispersion containing emulsified particles having a dispersion particle diameter of 340 nm.

Next, an initiator solution in which 6 parts by weight of potassium persulfate were dissolved in 200 parts by weight of ion-exchange water was added into the foregoing dispersion, and this system was heated at 80° C. for 3 hours while stirring to conduct polymerization (2$^{nd}$ step polymerization), and to obtain a resin particle dispersion.

(3) 3$^{rd}$ Step Polymerization (Formation of Outer Layer)

An initiator solution in which 5.45 parts by weight of potassium peroxide were dissolved in 220 parts by weight of ion-exchange water was added into the resulting "resin particle A2" dispersion as described above, and a mixture solution composed of the following compounds was dropped at 80° C. spending one hour.

| | |
|---|---|
| Styrene | 293.8 parts by weight |
| n-butyl acrylate | 154.1 parts by weight |
| n-octylmercaptan | 7.08 parts by weight |

After termination of dropping the foregoing monomer mixture solution, polymerization (3$^{rd}$ step polymerization) was conducted by heating while stirring for 2 hours, and subsequently, the system was cooled to 28° C. to prepare "core formation resin particle A". Glass transition temperature Tg of "core formation resin particle A" prepared via the 3$^{rd}$ step polymerization was 28.1° C.

Preparation of "Core Formation Resin Particle B"

(1) 1$^{st}$ Step Polymerization (Formation of Core Particle)

The following compounds were added in a reaction vessel fitted with a stirrer, a thermal sensor, a cooling pipe and a nitrogen introducing device, and the system was heated to 80° C. to obtain a polymerizable monomer solution.

| | |
|---|---|
| Styrene | 115.9 parts by weight |
| n-butyl acrylate | 47.4 parts by weight |
| Methacrylic acid | 12.3 parts by weight |
| Paraffin wax "HNP-57" (produced by Nippon Seiro Co., Ltd.) | 93.8 parts by weight |

On the other hand, a surfactant solution in which 2.9 parts by weight of an anionic surfactant represented by the following structural formula 2 was dissolved in 1340 parts by weight of ion-exchange water was prepared, and this was heated to 80° C. and charged in the foregoing reaction vessel.

$C_{10}H_{21}(OCH_2CH_2)_2OSO_3Na$ (Structural formula 2)

Then, a mixture/dispersion treatment was conducted for 2 hours employing a mechanical dispersion apparatus "CLEAR MIX" (manufactured by M Technique Co.) equipped with a circulation pass to prepare a dispersion containing emulsified particles (oil droplets) having a dispersion particle diameter of 245 nm.

Next, after adding 146 parts by weight of ion exchange water, an initiator solution in which 6.1 parts by weight of a polymerization initiator (potassium persulfate: KPS) and 1.8 parts by weight of n-octylmercaptan were dissolved in 237 parts by weight of ion-exchange water was added, and adjusted at 80° C. Then, polymerization ($1^{st}$ step polymerization) was conducted via heat while stirring at 80° C. for 3 hours to prepare a resin particle dispersion. This is designated as "resin particle B1".

(2) $2^{nd}$ Step Polymerization (Formation of Outer Layer)

An initiator solution in which 3.8 parts by weight of a polymerization initiator (potassium peroxide: KPS) were dissolved in 148 parts by weight of ion-exchange water was added into the resulting "resin particle B1" dispersion as described above, and a monomer mixture solution composed of the following compounds was dropped at 80° C. spending one hour.

| | |
|---|---|
| Styrene | 300.9 parts by weight |
| n-butyl acrylate | 146.9 parts by weight |
| Methacrylic acid | 3 parts by weight |
| n-octylmercaptan | 4.93 parts by weight |

After termination of dropping, polymerization ($2^{nd}$ step polymerization) was conducted by heating while stirring for 2 hours, and subsequently, the system was cooled to 28° C. to obtain "core formation resin particle B". Glass transition temperature Tg of "core formation resin particle B" was 36.0° C.

Preparation of "Core Formation Resin Particle C"

In preparation of "core formation resin particle B", the polymerizable monomer solution employed in the $1^{st}$ step polymerization was replaced by the following compounds.

| | |
|---|---|
| Styrene | 135.9 parts by weight |
| n-butyl acrylate | 27.4 parts by weight |
| Methacrylic acid | 12.3 parts by weight |

The initiator solution employed in the $1^{st}$ step polymerization was replaced by one in which 6.1 parts by weight of a polymerization initiator (potassium persulfate: KPS) and 0.8 parts by weight of n-octylmercaptan were dissolved in 237 parts by weight of ion-exchange water. "Core formation resin particle C" was prepared via the similar procedures for others. Glass transition temperature Tg of "core formation resin particle C" was 42.6° C.

Preparation of "Core Formation Resin Particle D"

(1) $1^{st}$ Step Polymerization (Formation of Core Particle)

A surfactant solution in which 4 parts by weight of an anionic surfactant represented by the foregoing structural formula 2 was dissolved in 3040 parts by weight of ion-exchange water was charged in a reaction vessel fitted with a stirrer, a thermal sensor, a cooling pipe and a nitrogen introducing device, and the system was heated to 80° C. while stirring at an stirring speed of 230 rpm under nitrogen flow.

An initiator solution in which 10 parts by weight of a polymerization initiator (potassium persulfate: KPS) were dissolved in 400 parts by weight of ion-exchange water was added into this surfactant solution, and the system was set to a temperature of 75° C. to subsequently drop a monomer mixture solution composed of the following compounds spending one hour.

| | |
|---|---|
| Styrene | 528 parts by weight |
| n-butyl acrylate | 204 parts by weight |
| Methacrylic acid | 68 parts by weight |
| n-octyl-3-mercaptopropionic acid ester | 24.4 parts by weight |

After dropping the foregoing monomer mixture solution, this system was heated at 75° C. for 2 hours while stirring, and polymerization ($1^{st}$ step polymerization) was conducted to prepare resin particles. These are designated as "resin particle D1".

(2) $2^{nd}$ Step Polymerization (Formation of Intermediate Layer)

The following compounds were added into a flask fitted with a stirring device to prepare a monomer mixture solution, and paraffin wax "HNP-57" (produced by Nippon Seiro Co., Ltd.) as a releasing agent was added into the foregoing monomer mixture solution and dissolved via heating to 90° C. to prepare a monomer solution.

| | |
|---|---|
| Styrene | 95 parts by weight |
| n-butyl acrylate | 36 parts by weight |
| Methacrylic acid | 9 parts by weight |
| n-octyl-3-mercaptopropionic acid ester | 0.69 parts by weight |

On the other hand, a surfactant solution in which 1 part by weight of an anionic surfactant represented by the above-described structural formula 2 was dissolved in 1560 parts by weight of ion-exchange water was heated to 98° C., and 28 parts by weight of a dispersion of the foregoing "resin particle D1" in terms of the solid content conversion were added into this surfactant solution. After the addition, a monomer solution in which the foregoing releasing agent was dissolved was mixed and dispersed for 8 hours by a mechanical dispersion apparatus "CLEAR MIX" (manufactured by M Technique Co.) equipped with a circulation pass to prepare a dispersion containing emulsified particles having a dispersion particle diameter of 284 nm.

Next, an initiator solution in which 5 parts by weight of potassium persulfate were dissolved in 200 parts by weight of ion-exchange water was added into this dispersion, and this system was heated at 98° C. for 12 hours while stirring to conduct polymerization ($2^{nd}$ step polymerization), and to obtain a dispersion of "resin particle D2".

(3) 3rd Step Polymerization (Formation of Outer Layer)

An initiator solution in which 6.8 parts by weight of potassium peroxide were dissolved in 265 parts by weight of ion-exchange water was added into the resulting "resin particle D2" dispersion as described above, and a monomer mixture solution composed of the following compounds was dropped at 80° C. spending one hour.

| | |
|---|---|
| Styrene | 242.5 parts by weight |
| n-butyl acrylate | 96.5 parts by weight |
| Methacrylic acid | 18 parts by weight |
| n-octyl-3-mercaptopropionic acid ester | 8.0 parts by weight |

After termination of dropping the foregoing monomer mixture solution, polymerization (3rd step polymerization) was conducted by heating while stirring for 2 hours, and subsequently, the system was cooled to 28° C. to prepare "core formation resin particle D". Glass transition temperature Tg of "core formation resin particle D" prepared via the 3rd step polymerization was 52.3° C.

Preparation of "Core Formation Resin Particle E"

In preparation of "core formation resin particle B", a polymerizable monomer solution employed in the 2nd step polymerization (formation of an outer layer) was replaced by the following compounds.

| | |
|---|---|
| Styrene | 135.9 parts by weight |
| n-butyl acrylate | 27.4 parts by weight |
| Methacrylic acid | 12.3 parts by weight |

The initiator solution employed in the 1st step polymerization was replaced by one in which 5.1 parts by weight of a polymerization initiator (potassium persulfate; KPS) were dissolved in 197 parts by weight of ion-exchange water. "Core formation resin particle E" was prepared via the similar procedures for others. Glass transition temperature Tg of "core formation resin particle E" was 9.2° C.

2-2 Preparation of "Shell Resin Particle 1"

"Shell resin particle F" was prepared similarly to preparation of the foregoing "core formation resin particle 1" to conduct polymerization reaction and a treatment after the reaction, except that with respect to the monomer mixture solution employed in the 1st step polymerization, a monomer mixture solution in which it was replaced by the following compounds and addition amounts was used.

| | |
|---|---|
| Styrene | 624 parts by weight |
| 2-ethylhexylacrylate | 120 parts by weight |
| Methacrylic acid | 56 parts by weight |
| n-octylmercaptan | 16.4 parts by weight |

Glass transition temperature Tg of this "shell resin particle F" was 62.6° C.

2-3 Preparation of "Yellow Toners 1-20"

Preparation of "Yellow Toner 1"

(1) Formation of Core Particle

In a reaction vessel fitted with a stirrer, a thermal sensor, a cooling pipe and a nitrogen introducing device, charged were 420.7 parts by weight (solid content conversion) of a dispersion of "core formation resin particle 1", 900 parts by weight of ion-exchange water and 200 parts by weight of "yellow colorant particle dispersion 1" while stirring. After temperature inside the vessel was adjusted to 30° C., 5 mol/litter of sodium hydroxide was added into this solution to adjust the pH to 8-11.

Next, an aqueous solution in which 2 parts by weight of magnesium chloride hexahydrate were dissolved in 1,000 parts by weight of ion-exchange water was added at 30° C. for 10 minutes while stirring. After standing for 3 minutes, the temperature was increased to 65° C., and temperature of this system was increased to 65° C. In such the state, the particle diameter of associated particles was measured employing "Multisizer III" (produced by Beckman Coulter Co.), and when a volume-based median particle diameter $D_{50}$ reached 5.5 μm, the particle diameter increase was terminated via addition of an aqueous solution prepared by dissolving 40.2 parts by weight of sodium chloride in 1,000 parts by weight of ion-exchange water. Further, ripening was conducted at a liquid temperature of 70° C. for one hour by heating while stirring to continue the fusion, and then, "core particle 1" was formed. The circularity of obtained "core particle 1" was determined via "FPTA2100" (produced by SYSTEX Co., Ltd.), resulting in an average circularity of 0.912.

(2) Formation of Shell Layer

Next, 96 parts by weight of a dispersion of "shell resin particle 1" were added at 65° C., and an aqueous solution in which 2 parts by weight of magnesium chloride hexahydrate were dissolved in 1,000 parts by weight of ion-exchange water was further added for 10 minutes. After the addition, the temperature was increased to 70° C. (shell forming temperature), and stirring was continued spending one hour to fuse "shell resin particle 1" on the surface of "core particle 1". After this, a ripening treatment was conducted at 75° C. for 20 minutes to form a shell layer.

Herein, 40.2 parts by weight of sodium chloride were added, the system was cooled to 30° C. at a rate of 6° C./minute, the resulting colored particles were filtrated, and washing was repeated with ion-exchanged water at 45° C. Thereafter, drying was conducted employing 40° C. air flow to obtain "yellow toner 1" formed on the core particle surface. In addition, circularity of "yellow toner 1" was measured, resulting in an average circularity of 0.952 and a volume-based median particle diameter $D_{50}$ of 5.9 μm. Kinds and contents of yellow colorants employed for "yellow toner 1" are shown in Table 1.

Preparation of "Yellow Toners 2-20"

"Yellow toners 2-20" were prepared similarly to preparation of "yellow toner 1", except that "core formation resin particle 1" and "yellow colorant particle dispersion 1" were replaced by the core formation resin particles and the yellow colorant particle dispersions described in Table 2, respectively. Kinds and contents of yellow colorants each constituting a yellow colorant employed for the resulting "yellow toners 1-20" have been shown, and maximum chroma, lightness at the maximum chroma and reflectance at each of predetermined wavelengths are shown in Table 3. The core formation resin particle of each toner, glass transition temperature and weight average molecular weight of each core particle and softening point temperature of toner are shown in Table 4.

TABLE 3

| Yellow toner No. | Yellow colorant particle dispersion No. | Toner: Volume-based median particle diameter (μm) | Toner: Average circularity | Toner image: Maximum chroma | Toner image: Lightness at maximum chroma | Toner image: Reflectance (Unit: %) $A_{415}+A_{460}$ | $A_{510}+A_{490}$ | $A_{550}+A_{530}$ | $A_{550}$ | Remarks |
|---|---|---|---|---|---|---|---|---|---|---|
| 1 | 1 | 5.9 | 0.952 | 95 | 81 | 14 | 30 | 5 | 80 | Inv. |
| 2 | 2 | 5.8 | 0.950 | 91 | 79 | 12 | 28 | 14 | 82 | Comp. |
| 3 | 3 | 5.9 | 0.954 | 89 | 77 | 12 | 28 | 3 | 83 | Comp. |
| 4 | 4 | 6.0 | 0.953 | 90 | 80 | 24 | 30 | 16 | 82 | Inv. |
| 5 | 5 | 5.8 | 0.590 | 88 | 82 | 24 | 30 | 2 | 81 | Inv. |
| 6 | 6 | 5.8 | 0.954 | 96 | 81 | 24 | 30 | 8 | 76 | Inv. |
| 7 | 7 | 5.8 | 0.952 | 95 | 83 | 3 | 30 | 10 | 78 | Inv. |
| 8 | 8 | 5.9 | 0.952 | 89 | 78 | 3 | 30 | 16 | 77 | Comp. |
| 9 | 9 | 5.9 | 0.951 | 88 | 76 | 3 | 20 | 4 | 80 | Comp. |
| 10 | 10 | 5.8 | 0.948 | 90 | 82 | 13 | 37 | 15 | 76 | Inv. |
| 11 | 11 | 5.8 | 0.946 | 91 | 80 | 13 | 37 | 15 | 75 | Inv. |
| 12 | 12 | 5.9 | 0.950 | 99 | 86 | 24 | 40 | 2 | 74 | Inv. |
| 13 | 13 | 5.9 | 0.957 | 89 | 76 | 24 | 20 | 9 | 77 | Comp. |
| 14 | 14 | 6.0 | 0.954 | 88 | 75 | 24 | 20 | 16 | 78 | Comp. |
| 15 | 15 | 5.8 | 0.953 | 93 | 86 | 13 | 37 | 9 | 76 | Inv. |
| 16 | 16 | 5.8 | 0.951 | 97 | 88 | 24 | 40 | 2 | 74 | Inv. |
| 17 | 17 | 5.8 | 0.957 | 94 | 89 | 24 | 40 | 9 | 80 | Inv. |
| 18 | 18 | 5.9 | 0.953 | 99 | 84 | 3 | 40 | 10 | 82 | Inv. |
| 19 | 19 | 5.8 | 0.954 | 101 | 83 | 3 | 40 | 16 | 82 | Inv. |
| 20 | 20 | 5.9 | 0.956 | 92 | 88 | 26 | 38 | 15 | 83 | Inv. |

Inv.: Present invention,
Comp.: Comparative example

TABLE 4

| Yellow toner No. | Core formation resin particle No. | Core particle: Glass transition temperature (° C.) | Core particle: Weight average molecular weight (Mw) | Toner Softening point temperature (° C.) |
|---|---|---|---|---|
| 1 | A | 28.1 | 10600 | 88 |
| 2 | D | 52.8 | 16000 | 114 |
| 3 | D | 52.8 | 16000 | 114 |
| 4 | B | 36.0 | 15400 | 99 |
| 5 | B | 36.0 | 15400 | 99 |
| 6 | B | 36.0 | 15400 | 99 |
| 7 | B | 36.0 | 15400 | 99 |
| 8 | D | 52.8 | 16000 | 114 |
| 9 | D | 52.8 | 16000 | 114 |
| 10 | B | 36.0 | 15400 | 99 |
| 11 | C | 42.6 | 14200 | 112 |
| 12 | C | 42.6 | 14200 | 112 |
| 13 | D | 52.8 | 16000 | 114 |
| 14 | E | 9.2 | 20100 | 74 |
| 15 | A | 28.1 | 10600 | 88 |
| 16 | A | 28.1 | 10600 | 88 |
| 17 | A | 28.1 | 10600 | 88 |
| 18 | A | 28.1 | 10600 | 88 |
| 19 | A | 28.1 | 10600 | 88 |
| 20 | A | 28.1 | 10600 | 88 |

3. Preparation of "Magenta Toners 1-20"

(1) Preparation of "Magenta Colorant Particle Dispersion 1"

The following magenta colorant was gradually added into a solution in which 11.5 parts by weight of sodium n-dodecylsulfate were dissolved in 160 parts by weight of ion-exchanged water.

| | |
|---|---|
| Complex compound 1 | 22.5 parts by weight |
| C.I. Solvent red 49 | 2.5 parts by weight |

Next, a dispersion treatment was conducted employing a homogenizer "CLEARMIX W MOTION CLM-0.8" (manufactured by M Technique Co.) to prepare "magenta colorant particle dispersion 1" having a volume-based median particle diameter of 126 nm.

(2) Preparation of "Magenta Colorant Particle Dispersions 2-20"

"Magenta colorant particle dispersions 2-20" were prepared similarly to preparation of "magenta colorant particle dispersion 1", except that magenta colorant kind and the addition amount were replaced by those described in Table 5.

TABLE 5

| *1 | Pigment for magenta colorant: M1 Kind | M1 Addition amount (Parts by weight) | M2 Kind | M2 Addition amount (Parts by weight) | Weight ratio M1:M2 | Remarks |
|---|---|---|---|---|---|---|
| 1 | Formula-1 | 22.5 | S.R.49 | 2.5 | 90:10 | Inv. |
| 2 | P.R.122 | 22.5 | P.R.9 | 2.5 | 90:10 | Comp. |
| 3 | P.R.9 | 25.0 | — | 0 | — | Comp. |
| 4 | Formula-3 | 20.5 | P.R.9 | 4.5 | 82:18 | Inv. |
| 5 | Formula-4 | 12.5 | P.R.9 | 12.5 | 50:50 | Inv. |
| 6 | Formula-1 | 22.5 | S.R.49 | 2.5 | 90:10 | Inv. |
| 7 | Formula-3 | 7.5 | S.R.49 | 17.5 | 30:70 | Inv. |
| 8 | P.R.209 | 15.0 | P.R.9 | 10.0 | 60:40 | Comp. |
| 9 | P.R.122 | 22.5 | P.R.57 | 2.5 | 90:10 | Comp. |
| 10 | Formula-3 | 12.5 | P.R.9 | 12.5 | 50:50 | Inv. |
| 11 | Formula-3 | 20.5 | P.R.208 | 4.5 | 82:18 | Inv. |
| 12 | Formula-4 | 12.5 | P.R.209 | 12.5 | 50:50 | Inv. |
| 13 | P.R.81:4 | 5.0 | P.R.208 | 20 | 20:80 | Comp. |
| 14 | P.R.81:4 | 18.75 | P.R.48 | 6.25 | 75:25 | Comp. |
| 15 | Formula-2 | 23.75 | P.R.9 | 1.25 | 95:5 | Inv. |
| 16 | Formula-1 | 12.5 | P.R.9 | 12.5 | 50:50 | Inv. |
| 17 | P.R.81:4 | 0.75 | P.R.209 | 24.25 | 3:97 | Inv. |
| 18 | Formula-2 | 0.75 | P.R.9 | 12.5 | 50:50 | Inv. |

TABLE 5-continued

| | Pigment for magenta colorant | | | | | |
|---|---|---|---|---|---|---|
| | M1 | | M2 | | | |
| *1 | Kind | Addition amount (Parts by weight) | Kind | Addition amount (Parts by weight) | Weight ratio M1:M2 | Remarks |
| 19 | Formula-3 | 100 | — | 0 | — | Inv. |
| 20 | Formula-1 | 17.5 | P.R.9 | 7.5 | 70:30 | Inv. |

*1: Magenta colorant particle dispersion No.
P.R.: Pigment Red
Inv.: Present invention
S.R.: Solvent Red
Comp.: Comparative example (3) Preparation of "Magenta Toners 1-20"

"Magenta toners 1-20" were prepared similarly to preparation of "yellow toner 1", except that "yellow colorant particle dispersion 1" was replaced by "magenta colorant particle dispersions 1-20" shown in Table 6. Kinds and contents of magenta colorants each constituting a magenta colorant employed for the resulting "magenta toners 1-20", and reflectance at each of predetermined wavelengths are shown in Table 6. Further, the core formation resin particle constituting each toner, glass transition temperature and weight average molecular weight of each core particle, and softening point temperature of toner are shown in Table 7.

TABLE 7-continued

| | | Core particle | | |
|---|---|---|---|---|
| Magenta toner No. | Core formation resin particle No. | Glass transition temperature (° C.) | Weight average molecular weight (Mw) | Toner Softening point temperature (° C.) |
| 4 | B | 36.0 | 15400 | 99 |
| 5 | B | 36.0 | 15400 | 99 |
| 6 | B | 36.0 | 15400 | 99 |
| 7 | B | 36.0 | 15400 | 99 |
| 8 | D | 52.8 | 16000 | 114 |
| 9 | D | 52.8 | 16000 | 114 |
| 10 | B | 36.0 | 15400 | 99 |
| 11 | C | 42.6 | 14200 | 112 |
| 12 | C | 42.6 | 14200 | 112 |
| 13 | D | 52.8 | 16000 | 114 |
| 14 | E | 9.2 | 20100 | 74 |
| 15 | A | 28.1 | 10600 | 88 |
| 16 | A | 28.1 | 10600 | 88 |
| 17 | A | 28.1 | 10600 | 88 |
| 18 | A | 28.1 | 10600 | 88 |
| 19 | A | 28.1 | 10600 | 88 |
| 20 | A | 28.1 | 10600 | 88 |

TABLE 6

| | Magenta | Toner | | Toner image | | | | | |
|---|---|---|---|---|---|---|---|---|---|
| | | | | | | Reflectance (Unit: %) | | | |
| Magenta toner No. | colorant particle dispersion No. | Volume-based median particle diameter (μm) | Average circularity | Maximum chroma | Lightness at maximum chroma | $B_{450}-B_{520}$ | $B_{530}-B_{570}$ | $B_{670}-B_{600}$ | $B_{670}$ |
| 1 | 1 | 5.9 | 0.952 | 95 | 45 | 55 | 18 | 34 | 90 |
| 2 | 2 | 5.8 | 0.954 | 50 | 21 | 19 | 8 | 48 | 90 |
| 3 | 3 | 5.8 | 0.954 | 52 | 15 | 30 | 26 | 22 | 90 |
| 4 | 4 | 5.7 | 0.950 | 90 | 49 | 48 | 6 | 4 | 90 |
| 5 | 5 | 5.8 | 0.590 | 88 | 49 | 80 | 6 | 5 | 90 |
| 6 | 6 | 5.9 | 0.954 | 96 | 36 | 55 | 18 | 34 | 91 |
| 7 | 7 | 5.9 | 0.952 | 95 | 51 | 54 | 18 | 12 | 91 |
| 8 | 8 | 5.7 | 0.952 | 101 | 24 | 19 | 8 | 6 | 90 |
| 9 | 9 | 5.9 | 0.951 | 92 | 20 | 19 | 24 | 5 | 90 |
| 10 | 10 | 5.8 | 0.953 | 90 | 39 | 48 | 6 | 9 | 90 |
| 11 | 11 | 5.8 | 0.590 | 91 | 36 | 80 | 6 | 5 | 92 |
| 12 | 12 | 5.7 | 0.954 | 99 | 41 | 30 | 14 | 22 | 93 |
| 13 | 13 | 5.9 | 0.952 | 55 | 28 | 30 | 15 | 47 | 93 |
| 14 | 14 | 5.8 | 0.952 | 51 | 33 | 30 | 14 | 5 | 93 |
| 15 | 15 | 5.9 | 0.953 | 91 | 44 | 50 | 15 | 49 | 90 |
| 16 | 16 | 5.7 | 0.952 | 97 | 36 | 33 | 7 | 25 | 90 |
| 17 | 17 | 5.8 | 0.951 | 94 | 35 | 33 | 8 | 45 | 90 |
| 18 | 18 | 5.7 | 0.948 | 89 | 38 | 33 | 7 | 25 | 90 |
| 19 | 19 | 5.9 | 0.946 | 89 | 51 | 50 | 21 | 1 | 92 |
| 20 | 20 | 5.7 | 0.950 | 88 | 44 | 52 | 7 | 46 | 90 |

TABLE 7

| | | Core particle | | |
|---|---|---|---|---|
| Magenta toner No. | Core formation resin particle No. | Glass transition temperature (° C.) | Weight average molecular weight (Mw) | Toner Softening point temperature (° C.) |
| 1 | A | 28.1 | 10600 | 88 |
| 2 | D | 52.8 | 16000 | 114 |
| 3 | D | 52.8 | 16000 | 114 |

4. Preparation of "Cyan Toners 1-13"

(1) Preparation of "Cyan Colorant Particle Dispersion 1"

The following cyan colorant was gradually added into a solution in which 11.5 parts by weight of sodium n-dodecylsulfate were dissolved in 160 parts by weight of ion-exchanged water.

| | |
|---|---|
| Cyan colorant I-1 | 2.5 parts by weight |
| Cyan colorant II-1 | 22.5 parts by weight |

A dispersion treatment was conducted employing a homogenizer "CLEARMIX W MOTION CLM-0.8" (manufactured by M Technique Co.) to prepare "cyan colorant particle dispersion 1" having a volume-based median particle diameter of 130 nm (2) Preparation of "Cyan Colorant Particle Dispersions 2-13"

"Cyan colorant particle dispersions 2-13" were prepared similarly to preparation of "cyan colorant particle dispersion 1", except that cyan colorant kind and the addition amount were replaced by those described in Table 8.

TABLE 8

| | Pigment for cyan colorant | | | | | |
|---|---|---|---|---|---|---|
| | C1 | | C2 | | | |
| *1 | Kind | Addition amount (Parts by weight) | Kind | Addition amount (Parts by weight) | Weight ratio C1:C2 | Remarks |
| 1 | 1-1 | 2.5 | Formula II-1 | 22.5 | 10:90 | Inv. |
| 2 | 1-1 | 22.5 | Formula II-2 | 2.5 | 90:10 | Inv. |
| 3 | 1-2 | 15.0 | Formula II-3 | 10.0 | 60:40 | Inv. |
| 4 | 1-3 | 20.0 | Formula II-4 | 5.0 | 80:20 | Inv. |
| 5 | 1-4 | 23.75 | Formula II-5 | 1.25 | 95:5 | Inv. |
| 6 | 1-5 | 22.5 | Formula II-6 | 2.5 | 90:10 | Inv. |
| 7 | 1-6 | 22.5 | Formula II-1 | 2.5 | 90:10 | Inv. |
| 8 | 1-7 | 25.0 | Formula II-2 | 0 | — | Inv. |
| 9 | 1-8 | 23.5 | Formula II-3 | 1.25 | 95:5 | Inv. |
| 10 | 1-9 | 19.5 | Formula II-4 | 5.5 | 78:22 | Inv. |
| 11 | 1-10 | 17.0 | Formula II-5 | 8.0 | 68:32 | Inv. |
| 12 | P.B.15:3 | 100 | — | 0 | — | Comp. |
| 13 | P.B.15:3 | 20.0 | Formula II | 5.0 | 60:40 | Comp. |

*1: cyan colorant particle dispersion No.
P.B.: Pigment Blue
Inv.: Present invention
Comp.: Comparative example (3) Preparation of "Cyan Toners 1-13"

"Cyan toners 1-13" were prepared similarly to preparation of "yellow toner 1", except that "yellow colorant particle dispersion 1" was replaced by "cyan colorant particle dispersions 1-13". Reflectance at each of the predetermined wavelengths of the resulting "cyan toners 1-13" is shown in Table 9. Further, the core formation resin particle constituting each toner, glass transition temperature and weight average molecular weight of each core particle, and softening point temperature of toner are shown in Table 10.

TABLE 10

| | | Core particle | | |
|---|---|---|---|---|
| Cyan toner No. | Core formation resin particle No. | Glass transition temperature (° C.) | Weight average molecular weight (Mw) | Toner Softening point temperature (° C.) |
| 1 | A | 28.1 | 10600 | 88 |
| 2 | A | 28.1 | 10600 | 88 |
| 3 | D | 52.8 | 16000 | 114 |
| 4 | B | 36.0 | 15400 | 99 |
| 5 | B | 36.0 | 15400 | 99 |
| 6 | B | 36.0 | 15400 | 99 |
| 7 | B | 36.0 | 15400 | 99 |
| 8 | D | 52.8 | 16000 | 114 |
| 9 | D | 52.8 | 16000 | 114 |
| 10 | B | 36.0 | 15400 | 99 |
| 11 | E | 9.2 | 20100 | 74 |
| 12 | A | 28.1 | 10600 | 88 |
| 13 | A | 28.1 | 10600 | 87 |

5. Evaluation Experiment 5-1. Preparation of Developer

A ferrite carrier having a volume average particle diameter of 50 μm obtained by coating a methylmethacrylate resin was mixed with respect to the foregoing "yellow toners 1-20" so as to give a toner content of 6% by weight to prepare "yellow developers 1-20" as the two-component developer. With respect to "magenta toners 1-20" and "cyan toners 1-13", the foregoing ferrite carrier was mixed similarly to the foregoing procedures to prepare "magenta developers 1-20" and "cyan developers 1-20" as the two-component developer.

5-2. Evaluation Experiment

A set of color developers composed of 22 kinds of a yellow developer, a magenta developer and a cyan developer was arranged to be prepared by using "yellow developers 1-20", "magenta developers 1-20" and "cyan developers 1-13" in combination to place "Examples 1-16" and "Comparative examples 1-9". The specific combination of developers are shown in the after-mentioned Table 11.

As to evaluations, a developing device having each developer is installed in a commercially available composite machine "biz hub PRO C6500" (manufactured by Konica Minolta Business Technologies, Inc.), which is suitable for a

TABLE 9

| | | Toner | | Toner image | | | | | |
|---|---|---|---|---|---|---|---|---|---|
| | | | | | | Reflectance (Unit: %) | | | |
| Cyan toner No. | Cyan colorant particle dispersion No. | Volume-based median particle diameter (μm) | Average circularity | Maximum chroma | Lightness at maximum chroma | $C_{480} - C_{450}$ | $C_{550} - C_{570}$ | $C_{570}$ | $C_{620} + C_{650}$ |
| 1 | 1 | 5.9 | 0.952 | 71 | 70 | 4 | 20 | 35 | 15 |
| 2 | 2 | 5.8 | 0.553 | 64 | 61 | 7 | 25 | 40 | 20 |
| 3 | 3 | 5.9 | 0.950 | 62 | 67 | 10 | 19 | 38 | 25 |
| 4 | 4 | 5.7 | 0.952 | 74 | 67 | 15 | 16 | 39 | 24 |
| 5 | 5 | 5.8 | 0.590 | 54 | 54 | 12 | 30 | 22 | 28 |
| 6 | 6 | 5.8 | 0.954 | 59 | 64 | 5 | 28 | 28 | 31 |
| 7 | 7 | 5.8 | 0.951 | 58 | 64 | 8 | 31 | 32 | 34 |
| 8 | 8 | 5.7 | 0.952 | 61 | 67 | 11 | 28 | 51 | 22 |
| 9 | 9 | 5.9 | 0.950 | 54 | 53 | 6 | 22 | 47 | 31 |
| 10 | 10 | 5.8 | 0.952 | 63 | 57 | 9 | 24 | 23 | 45 |
| 11 | 11 | 5.8 | 0.956 | 67 | 67 | 13 | 25 | 35 | 29 |
| 12 | 12 | 5.7 | 0.955 | 63 | 49 | 2 | 10 | 11 | 14 |
| 13 | 13 | 5.7 | 0.955 | 66 | 52 | 3 | 14 | 27 | 15 |

two-component developing system image forming apparatus shown in FIG. 1 to conduct the following evaluation at a temperature of 20° C. and a humidity of 50% RH.

(1) Halftone Image Evaluation (Granularity and Evenness)

Sample No. 5-1 (Color continuous tone portrait and color tone batch) of "test chart No. 3 of the imaging society of Japan" issued by the 1st committee of the imaging society of Japan was output to visually evaluate images. Focusing on skin color of portraits and softening feeling of images of flowers and ornamental plans, evaluation was made based on the following criteria. A and B were indicated as "pass".

(Evaluation Criteria)

A: No granularity can be visually seen at all, and no toner particle to cause dust was observed when observation between dots was made employing a loupe at an magnification of 20 times.

B: A slight granularity can be visually seen, or 1-3 toner particles to cause dust were observed when observation between dots was made employing a loupe at an magnification of 20 times.

C: Low resolution feeling is visually developed in comparison to an image ranked B, or an uncountable number of toner particles to cause dust when observation between dots was made employing a loupe at an magnification of 20 times.

(2) Granularity Evaluation of Soft Tone Image

The granularity evaluation was made employing the following soft tone image. Herein, the soft tone means a color tone classified as color exhibiting mildly peaceful feeling in which a slight dullness is added into bright color.

As to the evaluation, patch images of soft tones of 8 colors (#cc6666, #cc9966, #cccc66, #cc6666, #99cc66, #66cc66, #66cccc and #6699cc) were output in the printer mode to comprehensively evaluate granularity of each image, based on the following criteria. A, B and C were indicated as "pass".

(Evaluation Criteria)

A: It was confirmed that an even halftone image in fine texture was reproduced in all patch images, when observing with a loupe at a magnification of 10 times.

B: There was no problem such as granularity of all patch images via visual observation, but the granularity was slightly damaged when observing with a loupe at a magnification of 10 times.

C: Damage of slight granularity of some patch images was visually observed, but images were determined to be within the allowable range.

D: Damage of granularity was visually observed, and there were low resolution images.

In addition, the computer display conditions to display the above-described soft tone images are as follows.

(Computer Display Condition)

Computer: iMAC (manufactured by Apple Inc.)

24 inch wide screen liquid crystal display viewing surface viewing surface resolution: 1920×1200 pixel 2.16 GHz Intel Core 2 Duo Processor 1

4 MB shared L2 cash

1 GB memory (2×512 MB SO-DIMM)

250 GM memory serial ATA Hard Drive 2

8× double-layer type Super Drive (DVD+R DL, DVD±RW and CD-RW)

NVIDIA GeForce 7300 GT 128 MB GDDR3 Memory AirMac Extreme and Bluetooth 2.0 installation Apple Remote (3) Granularity Evaluation of Dull Tone Image The granularity evaluation was made employing the following dull tone image. Herein, the dull tone means a color tone classified as color exhibiting mildly but slightly complicated feeling in which a slight dullness is added into bright color.

As to the evaluation, patch images of dull tones of 8 colors (#996666, #999966, #669966, #669999, #666699 and #996699) were output in the printer mode to comprehensively evaluate granularity of each image, based on the same criteria as in the granularity evaluation of the foregoing soft tone. A, B and C were indicated as "pass". Further, the computer display conditions to display patch images of dull tones of 6 colors are identical to those to display patch images of the foregoing soft tones.

(4) Color Tone Reproduction Evaluation of Green Based Color Code

Patch images in the green based color code of 8 colors were output on the foregoing computer display to prepare the printed matter applied to the foregoing patch image. What color the color tone of the resulting printed matter can be identified to has been determined.

The green based color code of 8 colors utilized for the evaluation is as follows. That is, YellowGreen (#9ACD32), GreenYellow (#ADFF2F), Chartreuse (#7FFF00), Lime (#00FF00), SpringGreen (#00FF7F), MediumSpringGreen (#00FA9A), LimeGreen (#32CD32) and MediumSeaGreen (#3CB371). The evaluation was made as follows. At least 6 colors were indicated as "pass".

(Evaluation Criteria)

(Excellent): 8 colors were identified.

(Good): A least 6 colors and less than 8 colors were identified.

(No Good): Less than 6 colors were only identified.

(5) Color Tone Reproduction Evaluation of Bluish-Violet Based Color Code

Patch images in the bluish-violet based color code of 7 colors were output on the foregoing computer display to prepare the printed matter applied to the foregoing patch image. What color the color tone of the resulting printed matter can be identified to has been determined.

The blueish-violet based color code of 7 colors utilized for the evaluation is as follows. #7f00ff, #7700ef, #7000e0, #6800d1, #6000c1, #5900b2 and #5100a3. The evaluation was made as follows. At least 5 colors were indicated as "pass".

(Evaluation Criteria)

(Excellent): 7 colors were identified.

(Good): A least 5 colors and less than 7 colors were identified.

(No Good): Less than 5 colors were only identified.

(6) Gloss Unevenness

As to 3 colors of yellow, magenta and cyan, each of solid pattern images of 3 colors of yellow, magenta and cyan was output on the A3 sized 135 kg paper sheet (thick paper) so as to give a toner adhesion amount of 4.5 g/m$^2$ to evaluate a gloss unevenness generation situation in the initial image for each color. As for the evaluation, gloss difference was determined employing a commercially available glossmeter PG-3G (manufactured by Nippon Denshoku Industries, Co., Ltd.: an incident angle of 75° ). Less than 14.0 were indicated as "pass".

(Excellent): A gloss difference of not more than 6

(Good): A gloss difference of more than 6 and not more than 14

(Feasible): A gloss difference of more than 14 and not more than 20

(No Good): A gloss difference of more than 20

Results are shown in Table 11.

TABLE 11

| | Developer (toner) in combination | | | Image quality evaluation results | | | | | |
|---|---|---|---|---|---|---|---|---|---|
| | Yellow No. | Magenta No. | Cyan No. | Granularity and evenness of halftone | Granularity of soft tone | Granularity of dull tone | Output of green based color code | Output of blueish-violet based color code | Gloss unevenness |
| **1 | 1 | 1 | 1 | A | A | A | 8 colors | 7 colors | 2.1 |
| **2 | 4 | 4 | 4 | A | A | A | 7 colors | 5 colors | 2.1 |
| **3 | 5 | 5 | 5 | A | A | A | 7 colors | 5 colors | 2.1 |
| **4 | 6 | 6 | 6 | A | A | A | 6 colors | 5 colors | 2.1 |
| **5 | 7 | 7 | 7 | A | B | A | 6 colors | 5 colors | 8.6 |
| **6 | 10 | 10 | 10 | B | B | B | 7 colors | 5 colors | 12.5 |
| **7 | 11 | 11 | 1 | B | B | B | 7 colors | 5 colors | 12.4 |
| **8 | 12 | 12 | 1 | A | A | A | 7 colors | 5 colors | 2.1 |
| **9 | 15 | 15 | 1 | A | A | A | 5 colors | 4 colors | 5.5 |
| **10 | 17 | 17 | 1 | A | A | C | 5 colors | 5 colors | 4.9 |
| **11 | 18 | 18 | 1 | A | A | B | 5 colors | 5 colors | 4.0 |
| **12 | 19 | 19 | 1 | A | A | B | 5 colors | 5 colors | 3.4 |
| **13 | 20 | 20 | 1 | A | A | A | 8 colors | 7 colors | 2.1 |
| **14 | 12 | 1 | 4 | A | A | A | 8 colors | 7 colors | 0.4 |
| **15 | 15 | 5 | 6 | A | A | A | 8 colors | 7 colors | 0.3 |
| **16 | 17 | 12 | 7 | A | A | A | 8 colors | 7 colors | 0.5 |
| Comp. 1 | 2 | 2 | 2 | D | D | D | 4 colors | 5 colors | 16.8 |
| Comp. 2 | 3 | 3 | 3 | D | D | C | 4 colors | 5 colors | 15.9 |
| Comp. 3 | 8 | 8 | 8 | D | D | D | 4 colors | 4 colors | 15.5 |
| Comp. 4 | 9 | 9 | 9 | D | D | C | 4 colors | 5 colors | 14.6 |
| Comp. 5 | 13 | 13 | 1 | D | C | C | 4 colors | 5 colors | 20.0 |
| Comp. 6 | 14 | 14 | 11 | D | D | D | 4 colors | 4 colors | 16.8 |
| Comp. 7 | 16 | 16 | 12 | C | D | C | 5 colors | 4 colors | 15.3 |
| Comp. 8 | 1 | 2 | 1 | C | D | D | 6 colors | 5 colors | 21.2 |
| Comp. 9 | 2 | 1 | 1 | C | C | C | 4 colors | 5 colors | 20.5 |

**Example,
Comp.: Comparative example

As shown in Table 11, as to any of Examples 1-16 of the present invention, obtained were excellent results with respect to halftone images including soft tone and dull tone. On the other hand, in the case of Comparative examples 1-9 outside the present invention, halftone images in good image quality were not able to be obtained. In such the case, it was confirmed that observed was large difference with respect to image quality of the resulting toner image between those satisfying the present invention and those not satisfying the present invention.

[Effect of the Invention]

In the present invention, granularity and evenness in a secondary color halftone image were largely improved to add appearance of solidity to photographic images, for example, whereby eye-friendly comfortable high quality images were to be produced via addition of the evenness. Further, since an amount of reflected light of an image was increased, the color reproduction region for secondary color was also able to become enlarged. In addition, rich contrast was able to be obtained with respect to dark color formed by superimposing images of yellow, magenta and cyan in addition to black toner by increasing the amount of reflected light of an image.

What is claimed is:

1. A full-color image forming method comprising the step of:

forming a full-color image employing at least a yellow toner, a magenta toner and a cyan toner, wherein lightness $L^*_Y$ is in the range of 80-90 when a first toner image formed with only the yellow toner exhibits a maximum chroma; lightness $L^*_M$ is in the range of 35-51 when a second toner image formed with only the magenta toner exhibits a maximum chroma; and lightness $L^*_C$ is in the range of 53-70 when a third toner image formed with only the cyan toner exhibits a maximum chroma; and wherein the yellow toner contains yellow colorants selected from each of the following Group X and Group Y, and a weight ratio of the yellow colorant selected from Group X to the other yellow colorant selected from the Group Y is 65:35-95:5;

Group X: C.I. pigment yellow 3, C.I. pigment yellow 3, C.I. pigment yellow 35, C.I. pigment yellow 65, C.I. pigment yellow 74, C.I. pigment yellow 98 and C.I. pigment yellow 11;

Group Y: C.I. pigment yellow 9, C.I. pigment yellow 36, C.I. pigment yellow 83, C.I. pigment yellow 110, C.I. pigment yellow 139, C.I. pigment yellow 181 and C.I. pigment yellow 153.

2. The full-color image forming method of claim 1, wherein lightness $L^*_Y$ is in the range of 85-90 when a first toner image formed with only the yellow toner exhibits a maximum chroma; lightness $L^*_M$ is in the range of 40-49 when a second toner image formed with only the magenta toner exhibits a maximum chroma; and lightness $L^*_C$ is in the range of 57-67 when a third toner image formed with only the cyan toner exhibits a maximum chroma.

3. The full-color image forming method of claim 1, wherein the first toner image formed with only the yellow toner has a maximum chroma $C^*_Y$ of 85-115; the second toner image formed with only the magenta toner has a maximum chroma $C^*_M$ of 70-100; and the third toner image formed with only the cyan toner has a maximum chroma $C^*_C$ of 50-80.

4. The full-color image forming method of claim 2, wherein the first toner image formed with only the yellow toner has a maximum chroma $C^*_Y$ of 85-115; the second toner image formed with only the magenta toner has a maximum chroma $C^*_M$ of 70-100; and the third toner image formed with only the cyan toner has a maximum chroma $C^*_C$ of 50-80.

5. The full-color image forming method of claim 1, wherein reflected light of the second toner image satisfies the following inequalities (21)-(24);

$$30 \leqq B_{450} - B_{520} \leqq 85 \quad \text{Inequality (21)}$$

wherein $B_{450}$ represents reflectance (unit; %) at a wavelength of 450 nm, and $B_{520}$ represents reflectance (unit; %) at a wavelength of 520 nm;

$$1 \leqq B_{530} - B_{570} \leqq 25 \quad \text{Inequality (22)}$$

wherein $B_{530}$ represents reflectance (unit; %) at a wavelength of 530 nm, and $B_{570}$ represents reflectance (unit; %) at a wavelength of 570 nm;

$$2 \leqq B_{670} - B_{600} \leqq 50 \quad \text{Inequality (23)}$$

$$80 \leqq B_{670} \quad \text{Inequality (24)}$$

wherein $B_{670}$ represents reflectance (unit; %) at a wavelength of 670 nm, and $B_{600}$ represents reflectance (unit; %) at a wavelength of 600 nm.

6. The full-color image forming method of claim 1, wherein reflected light of the third toner image satisfies the following Inequalities (31)-(34);

$$4 \leqq |C_{480} - C_{450}| \leqq 16 \quad \text{Inequality (31)}$$

wherein $C_{480}$ represents reflectance (unit; %) at a wavelength of 480 nm, and $C_{450}$ represents reflectance (unit; %) at a wavelength of 450 nm;

$$15 \leqq C_{550} - C_{570} \leqq 35 \quad \text{Inequality (32)}$$

$$20 \leqq C_{570} \leqq 50 \quad \text{Inequality (33)}$$

wherein $C_{550}$ represents reflectance (unit; %) at a wavelength of 550 nm, and $C_{570}$ represents reflectance (unit; %) at a wavelength of 570 nm;

$$0 \leqq C_{620} + C_{650} \leqq 30 \quad \text{Inequality (34)}$$

wherein $C_{620}$ represents reflectance (unit; %) at a wavelength of 620 nm, and $C_{650}$ represents reflectance (unit; %) at a wavelength of 650 nm.

7. The full-color image forming method of claim 1, wherein each of the yellow toner, the magenta toner and the cyan toner has a softening point temperature of 75-112° C.

8. The full-color image forming method of claim 7, wherein each of the yellow toner, the magenta toner and the cyan toner has a softening point temperature of 80-100° C.

9. The full-color image forming method of claim 1, wherein each of the yellow toner, the magenta toner and the cyan toner comprises a resin selected from the group consisting of vinyl based resins, olefin based resins, polyester based resins, polyamide based resins, polycarbonate resins, polyether resins, polyvinyl acetate based resins, polysulfone resins, epoxy resins, polyurethane resins and urea resins.

* * * * *